US005089382A

United States Patent [19]

Sakai

[11] Patent Number: 5,089,382

[45] Date of Patent: Feb. 18, 1992

[54] SILVER HALIDE COLOR PHOTOGRAPHIC MATERIAL

[75] Inventor: Nobuo Sakai, Kanagawa, Japan

[73] Assignee: Fuji Photo Film Co., Ltd., Kanagawa, Japan

[21] Appl. No.: 422,461

[22] Filed: Oct. 17, 1989

[30] Foreign Application Priority Data

Oct. 18, 1988 [JP] Japan ..... 63-262206

[51] Int. Cl.[5] ..... G03C 1/08

[52] U.S. Cl. ..... 430/546; 430/550; 430/576; 430/584; 430/631; 430/961; 430/963

[58] Field of Search ..... 430/550, 546, 573, 578, 430/631, 963, 961, 576, 584

[56] References Cited

U.S. PATENT DOCUMENTS 4,427,764 1/1984 Tachibana et al. ..... 430/961
4,857,449 8/1989 Ogawa et al. ..... 430/550

FOREIGN PATENT DOCUMENTS 0276319 8/1988 European Pat. Off. .
0280238 8/1988 European Pat. Off. .
0313021 4/1989 European Pat. Off. ..... 430/550
53-85421 7/1978 United Kingdom ..... 430/550

OTHER PUBLICATIONS

Patent Abstracts of Japan, vol. 8, No. 282, (JP-A-59 148052).
Patent Abstracts of Japan, vol. 12, No. 58, (JP-A-62 203160).
Research Disclosure, No. 165, Jan. 1978, Havant GB, p. 20.
Research Disclosure, No. 167, Mar. 1978, Havant GB, p. 22.

*Primary Examiner*—Charles L. Bowers, Jr.
*Assistant Examiner*—Thomas R. Neville
*Attorney, Agent, or Firm*—Sughrue, Mion, Zinn Macpeak & Seas

[57] ABSTRACT

A silver halide color photographic light-sensitive material comprising a support having thereon at least one silver halide emulsion layer, wherein in at least one silver halide emulsion layer contains a compound represented by the following general formula (I)

(I)

wherein Z represents an oxygen atom or a sulfur atom; $R_{101}$ and $R_{102}$, which may be the same or different, represent each an alkyl group and at least one of $R_{101}$ and $R_{102}$ is a butyl group, a pentyl group, a hexyl group, a heptyl group or an octyl group; $V_1$, $V_2$, $V_3$, $V_4$, $V_5$, $V_6$, $V_7$ and $V_8$, which may be the same or different, each represent a hydrogen atom, a halogen atom, an alkyl group, an acyl group, an acyloxy group, an alkoxycarbonyl group, a carbamoyl group, a sulfamoyl group, a carboxyl group, a cyano group, an alkoxy group, an alkylthio group, an alkylsulfonyl group, a sulfo group or an aryl group; of $V_1$ to $V_8$, two groups attached to neighboring carbon atoms do not combine together to form a condensed ring, and when each Hammett's $\sigma p$ value is referred to as $\sigma pi(i=1\sim8)$ and $Y=\sigma p1+\sigma p2+\sigma p3+\sigma p4+\sigma p5+\sigma p6+\sigma p7+\sigma p8$, $Y\leqq-0.08$ where Z is an oxygen atom or $Y\leqq-0.15$ where Z is a sulfur atom; X represents a counter ion; and n represents a value required for the neutralization of electric charge; and the ratio ($V_o/V_g$) of the total volume ($V_o$) of oil droplets present in said silver halide emulsion layer to the total volume ($V_g$) of hydrophilic colloid present therein is 0.8 or greater.

16 Claims, No Drawings

SILVER HALIDE COLOR PHOTOGRAPHIC MATERIAL

FIELD OF THE INVENTION

This invention relates to a silver halide color photographic material, and more particularly to a silver halide color photographic material which scarcely undergoes a change in sensitivity even when stored over a long period of time and which has excellent pressure resistance.

BACKGROUND OF THE INVENTION

Various silver halide color photographic materials and various color image forming methods using them are widely used at present.

The requirements with respect to the silver halide color photographic materials have increased markedly in recent years. For example, the rapid processing performance of color photographic paper must be improved and at the same time, the photographic paper must be fed in a stable manner while keeping the printing conditions constant to finish a large quantity of prints in a short time.

In order to feed such a paper in a stable manner while keeping the printing conditions constant, variation in the sensitivity and gradation of the color photographic paper from lot to lot must not occur and a change in sensitivity and gradation must not occur even when the color photographic paper is stored over a long period of time.

Variation in sensitivity and gradation from lot to lot and change in sensitivity and gradation during long-term storage are particularly marked for the red-sensitive emulsion layers. A solution to these problems is definitely required.

The above lot-to-lot variation frequently occurs because the red-sensitive sensitizing dyes in the red-sensitive emulsion layers desorped from silver halide grains in the coating solutions with the passage of time, and, as a result, desensitization occurs. Various methods have been proposed to solve this problem with respect to the desensitization of the coating solutions with the passage of time. For example, the long-term stability of the coating solutions can be greatly improved by using stilbene compounds as described in JP-A-59-135461 (the term "JP-A" as used herein means an "unexamined published Japanese patent application"). JP-A-60-225147 discloses a method wherein a tetradecahedral silver chlorobromide grain emulsion sensitized with a certain red-sensitive sensitizing dye is used to improve the long-term stability of the coating solutions. However, these methods are insufficient to prevent a change in the sensitivity and gradation of photographic materials from occurring during long-term storage, though the long-term stability of the coating solutions is improved and variation of color photographic paper from lot to lot is reduced.

With regard to an improvement in rapid processing performance, the processing stages have been simplified and high-temperature development is generally conducted. In order to shortening the development time with high-temperature development, it is very important to improve the development rate in color development. It is known that this is greatly affected by the shape, size and composition of the silver halide grains and the condition of the color developing solutions. An improvement in rapid processing performance has been recently achieved by improving the silver halide emulsion grains and the compositions and conditions of the color developing solutions on the basis of this knowledge.

However, the conveying speed in automatic processors is increased in rapid processing. Thus, the frequency of sensitization and desensitization caused by scratching and pressure in various locations inside and outside an automatic processor is increased. Thus, it is necessary for the photographic materials to have high resistance to pressure.

Many studies have been reported that fogging or desensitization is caused by silver halide grains as an element of a photographic material when physical pressure is applied thereto.

For example, the deformation of silver halide grains caused by pressure, the strain of the crystals, the defects of the crystal latice in the deformed state and the influence of the deformation on the distribution of latent image centers are fully described in *J. Photo. Sci.*, 21, 221 to 226 (1973).

Methods for preventing fogging or desensitization from being caused by pressure include methods wherein pressure is not allowed to reach silver halide, or various gelatin polymers and various organic compounds are used in the protective layer, intermediate layer and silver halide-containing layers of the photographic materials. For example, a method using alkyl phthalates described in U.K. Patent 738,637, a method using alkyl esters described in U.K. Patent 738,639, a method using hydrophilic compounds, particularly polyhydric alcohols described in U.S. Pat. No. 2,960,404, a method using high-boiling organic compounds immiscible with hydrophilic binders described in JP-A-53-85421 and a method using alkyl acrylates and organosilver salts described in JP-B-53-28086 (the term "JP-B" as used herein means an "examined Japanese patent publication") are known.

However, these methods have little effect on high pressure. Moreover, these methods have disadvantages in that the surfaces of the photographic materials become excessively sticky and the photographic characteristics of the photographic materials are adversely affected. Thus, the primary object cannot be achieved.

SUMMARY OF THE INVENTION

Accordingly, a first object of the present invention is to provide a silver halide color photographic material which scarcely undergoes change in sensitivity and gradation even when stored over a long period of time.

A second object of the present invention is to provide a means for imparting pressure resistance to a photographic material without adversely affecting the photographic characteristics of the photographic material.

The objects of the present invention are achieved by providing a silver halide color photographic material comprising at least one silver halide emulsion layer on a support, wherein at least one layer of the silver halide emulsion layers contains a compound represented by the following general formula (I) and the ratio (Vo/Vg) of the total volume (Vo) of oil droplets present in this silver halide emulsion layer to the total volume (Vg) of hydrophilic colloid present therein is not lower than 0.8.

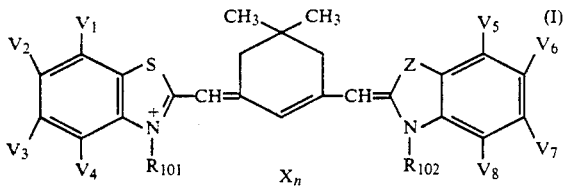

(I)

wherein Z represents an oxygen atom or a sulfur atom; $R_{101}$ and $R_{102}$, which may be the same or different, each represents an alkyl group and at least one of $R_{101}$ and $R_{102}$ is a butyl group, a pentyl group, a hexyl group, a heptyl group or an octyl group; $V_1$, $V_2$, $V_3$, $V_4$, $V_5$, $V_6$, $V_7$ and $V_8$, which may be the same or different, each represents a hydrogen atom, a halogen atom, an alkyl group, an acyl group, an acyloxy group, an alkoxycarbonyl group, a carbamoyl group, a sulfamoyl group, a carboxyl group, a cyano group, an alkoxy group, an alkylthio group, an alkylsulfonyl group, a sulfo group or an aryl group and, of $V_1$ to $V_8$, two groups attached to the neighboring carbon atoms do not combine together to form a condensed ring, and when the Hammett's $\sigma p$ value is referred to as $\sigma pi(i=1-8)$ and $Y=\sigma p1+\sigma p2+\sigma p3+\sigma p4+\sigma p5+\sigma p6+\sigma p7+\sigma p8$, $Y\leqq-0.08$ where Z is an oxygen atom or $Y\leqq-0.15$ where Z is a sulfur atom; X represents a counter ion for electric charge balance; and n represents a value required for the neutralization of electric charge.

Particularly, the above-described second object of the present invention is effectively achieved without causing troubles of film properties by providing a silver halide color photographic material in which the ratio (Vo/Vg) of the total volume (Vo) of oil droplets present in each of silver halide emulsion layers to the total volume (Vg) of hydrophilic colloid present in each of the silver halide emulsion layers is in the range of 0.9 to 1.6.

DETAILED DESCRIPTION OF THE INVENTION

When the ratio (Vo/Vg) is less than 0.8, the effects of the present invention can not be obtained satisfactorily. The ratio is preferably not more than 1.6, and more preferably it is within the range of from 0.9 to 1.3.

The substances which comprise oil droplets in the present invention are photographic additives which are oily or are soluble in an oil. Examples of such substance include high-boiling point organic solvents, oleophilic ultraviolet light absorber, couplers, water insoluble polymers, image stabilizing agents, and antifogging agent.

In view of coloring properties, it is preferred that the size of the oil droplets is preferably within the range of from 0.08 to 0.25 μm.

The coating amount of the hydrophilic colloid containing the droplets is preferably from 0.5 g/m$^2$ to 2 g/m$^2$.

The compounds represented by the formula (I) are illustrated in more detail below.

In the formula (I), Z is an oxygen atom or a sulfur atom.

$R_{101}$ and $R_{102}$ are each preferably an unsubstituted alkyl group having not more than 18 carbon atoms (e.g., methyl, ethyl, propyl, butyl, pentyl, hexyl, heptyl, octyl, decyl, dodecyl, octadecyl) or a substituted alkyl group having not more than 18 carbon atoms [examples of substituent groups include a carboxyl group, a sulfo group, a cyano group, a halogen atom (e.g., fluorine, chlorine, bromine), a hydroxyl group, an aryloxycarbonyl or alkoxycarbonyl group having not more than 8 carbon atoms (e.g., methoxycarbonyl, ethoxycarbonyl, phenoxycarbonyl, benzyloxycarbonyl), an alkoxy group having not more than 8 carbon atoms (e.g., methoxy, ethoxy, benzyloxy, phenethyloxy), a monocyclic aryloxy group having not more than 15 carbon atoms (e.g., phenoxy, p-tolyloxy), an acyloxy group having not more than 8 carbon atoms (e.g., acetyloxy, propionyloxy) (in the present invention an acyl group and an acyl moiety include both of an aliphatic and aromatic acyl groups and acyl moieties), an acyl group having not more than 8 carbon atoms (e.g., acetyl, propionyl, benzoyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), and an aryl group having not more than 15 carbon atoms (e.g., phenyl, 4-chlorophenyl, 4-methylphenyl, α-naphthyl)].

More preferably, and $R_{101}$ and $R_{102}$ are each an unsubstituted alkyl group (e.g., methyl, ethyl, propyl, butyl, pentyl, hexyl, heptyl, octyl) or a sulfoalkyl group (e.g., 2-sulfoethyl, 3-sulfopropyl, 4-sulfobutyl).

However, at least one of $R_{101}$ and $R_{102}$ is a butyl group, a pentyl group, a hexyl group, a heptyl group or an octyl group with a pentyl group being particularly preferred. These groups may be any one of n-, t or i-alkyl group.

$V_1$, $V_2$, $V_3$, $V_4$, $V_5$, $V_6$, $V_7$ and $V_8$ are each a hydrogen atom, a halogen atom (e.g., fluorine, chlorine, bromine), an unsubstituted alkyl group having not more than 10 carbon atoms (e.g., methyl, ethyl), a substituted alkyl group having not more than 18 carbon atoms (e.g., benzyl, α-naphthylmethyl, 2-phenylethyl, trifluoromethyl), an acyl group having not more than 8 carbon atoms (e.g., acetyl, benzoyl), an acyloxy group having not more than 8 carbon atoms (e.g., acetyloxy), an alkoxycarbonyl group having not more than 8 carbon atoms (e.g., methoxycarbonyl, ethoxycarbonyl, benzyloxycarbonyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), a carboxyl group, a cyano group, a hydroxyl group, an amino group, an acylamino group having not more than 8 carbon atoms (e.g., acetylamino), an alkoxy group having not more than 10 carbon atoms (e.g., methoxy, ethoxy, benzyloxy), an alkylthio group having not more than 10 carbon atoms (e.g., ethylthio), an alkylsulfonyl group having not more than 5 carbon atoms (e.g., methylsulfonyl), a sulfo group or an aryl group having not more than 15 carbon atoms (e.g., phenyl, tolyl).

More preferably, each of $V_1$ to $V_8$ is hydrogen atom, an unsubstituted alkyl group (e.g., methyl) or an alkoxy group (e.g., methoxy).

Two $V_1$ to $V_8$ groups attached to the neighboring carbon atoms are not combined together to form a condensed ring. When Hammett's $\sigma p$ value is referred to as $\sigma pi(i=1-8)$ and $Y=\sigma p1+\sigma p2+\sigma p3+\sigma p4+\sigma p5+\sigma p6+\sigma p7+\sigma p8$, $Y\leqq-0.08$ where Z is an oxygen atom or $Y\leqq-0.15$ where Z is a sulfur atom. More preferably, $Y\leqq-0.15$ where Z is an oxygen atom or $Y\leqq-0.30$ where Z is a sulfur atom. When Y satisfies these inequalities a photographic material having a high sensitivity and having less exposing temperature dependency can be obtained. Most preferred Y values are such that $-0.90 \leqq Y \leqq -0.17$ when Z is an oxygen atom or $-1.05 \leqq Y \leqq -0.34$ when Z is a sulfur atom.

$\sigma p$ is a value described in *Chemical Region,* extra issue number 122, *Guide to Structural Activity Correlation of Drugs—Drug Design and Functional Mechanism Study,* pages 96–103, edited by Structural Activity Correlation Gathering Meeting Society (published by Nakodo, in Japanese) and Corwin Hansch and Albert Leo, *Substituent Constants for Correlation Analysis in Chemistry and Biology,* pages 69–161 (John Wiley and Sons). A method for measuring $\sigma p$ is described in *Chemical Reviews,* Vol. 17, pages 125–136 (1935).

According to these literature references, the value of $\sigma p$ is 0 for a hydrogen atom, −0.17 for a methyl group and −0.27 for a methoxy group.

Xn is included in the formula to show the presence or absence of an anion when required for making the ionic charge of the dye neutral. Accordingly, n is an appropriate value of not smaller than 0.

Typical cations include inorganic or organic ammonium ions and alkali metal ions. Any of inorganic anions or organic anions can be used as anions. Examples of suitable anions include halogen ion (e.g., fluorine ion, chlorine ion, bromine ion, iodine ion), substituted arylsulfonate ion (e.g., p-toluenesulfonate ion, p-chlorobenzenesulfonate ion), aryl-disulfonate ions (e.g., 1,3-benzenedisulfonate ion, 1,5-naphthalenedisulfonate ion, 2,6-naphthalenedisulfonate ion), alkylsulfate ions (e.g., methylsulfate ion), sulfate ion, thiocyanate ion, perchlorate ion, tetrafluoroborate ion, picrate ion, acetate ion and trifluoromethanesulfonate ion. Of these, iodine ion is preferred.

Examples of the dyes represented by the formula (I) are set forth below but the present invention is not limited to the following compounds.

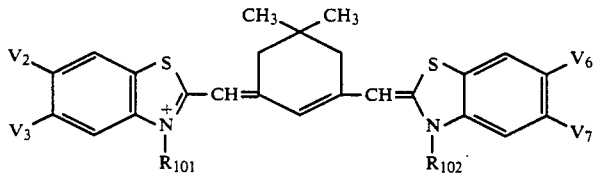

| Compound No. | $R_{101}$ | $R_{102}$ | $V_2$ | $V_3$ | $V_6$ | $V_7$ | X | n |
|---|---|---|---|---|---|---|---|---|
| 1 | $(CH_2)_3CH_3$ | $C_2H_5$ | $CH_3$ | H | $CH_3$ | H | $I^-$ | 1 |
| 2 | $(CH_2)_4CH_3$ | $C_2H_5$ | $CH_3$ | H | $CH_3$ | H | $I^-$ | 1 |
| 3 | $(CH_2)_5CH_3$ | $C_2H_5$ | $CH_3$ | H | $CH_3$ | H | $I^-$ | 1 |
| 4 | $(CH_2)_6CH_3$ | $C_2H_5$ | $CH_3$ | H | $CH_3$ | H | $I^-$ | 1 |
| 5 | $(CH_2)_7CH_3$ | $C_2H_5$ | $CH_3$ | H | $CH_3$ | H | $I^-$ | 1 |
| 6 | $(CH_2)_4CH_3$ | $C_2H_5$ | $CH_3$ | $CH_3$ | $CH_3$ | H | $I^-$ | 1 |
| 7 | $(CH_2)_3CH_3$ | $C_2H_5$ | $CH_3$ | $CH_3$ | $CH_3$ | H | $I^-$ | 1 |
| 8 | $(CH_2)_4CH_3$ | $C_2H_5$ | $CH_3$ | $CH_3$ | H | H | $I^-$ | 1 |
| 9 | $(CH_2)_4CH_3$ | $C_2H_5$ | H | H | $CH_3$ | $CH_3$ | $I^-$ | 1 |
| 10 | $(CH_2)_4CH_3$ | $(CH_2)_4CH_3$ | $CH_3$ | H | $CH_3$ | H | $I^-$ | 1 |
| 11 | $(CH_2)_4CH_3$ | $C_2H_5$ | $OCH_3$ | H | $OCH_3$ | H | $Br^-$ | 1 |
| 12 | $(CH_2)_4CH_3$ | $C_2H_5$ | $OCH_3$ | $OCH_3$ | H | H | $Cl^-$ | 1 |
| 13 | $(CH_2)_4CH_3$ | $(CH_2)_3SO_3^-$ | $OCH_3$ | H | $OCH_3$ | H | — | — |
| 14 | $(CH_2)_3CH_3$ | $(CH_2)_4SO_3^-$ | $OCH_3$ | H | $OCH_3$ | H | — | — |
| 15 | $(CH_2)_4CH_3$ | $CH_2CO_2H$ | $CH_3$ | H | $CH_3$ | H | 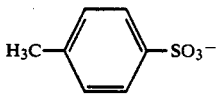 | 1 |
| 16 | $(CH_2)_4CH_3$ | $(CH_2)_3SO_3^-$ | $CH_3$ | H | $CH_3$ | H | — | — |
| 17 | $(CH_2)_4CH_3$ | $(CH_2)_4SO_3^-$ | $CH_3$ | H | $CH_3$ | H | — | — |
| 18 | $(CH_2)_5CH_3$ | $(CH_2)_2SO_3^-$ | $CH_3$ | $CH_3$ | H | H | — | — |
| 19 | $(CH_2)_3CH_3$ | $(CH_2)_2OCH_3$ | $CH_3$ | H | $CH_3$ | H | $I^-$ | 1 |
| 20 | $(CH_2)_4CH_3$ | $(CH_2)_2CN$ | H | $CH_3$ | H | $CH_3$ | $I^-$ | 1 |
| 21 | $(CH_2)_4CH_3$ | 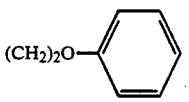 | H | $CH_3$ | H | $CH_3$ | $Br^-$ | 1 |

(22)

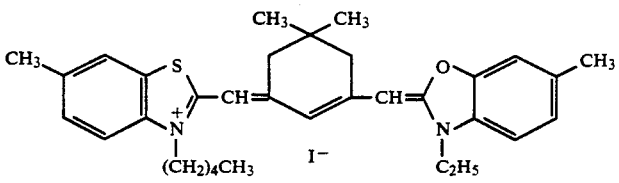

-continued

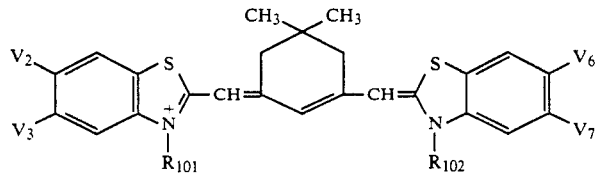

| Compound No. | $R_{101}$ | $R_{102}$ | $V_2$ | $V_3$ | $V_6$ | $V_7$ | X | n |
|---|---|---|---|---|---|---|---|---|
| (23) | 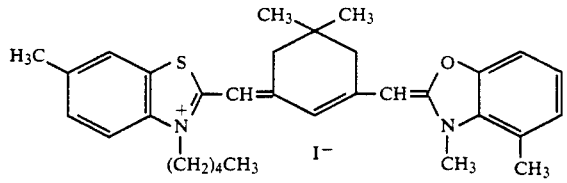 | | | | | | | |

The compounds having the formula (I) which are used in the present invention are disclosed in EP 313021 (published on Apr. 26, 1989) and they can be synthesized according to the methods described in F. M. Hamer, *Heterocyclic Compounds—Cyanine Dyes and Related Compounds,* Chapter IX, pages 270–287 (John Wiley and Sons, New York, London, 1946) and D. M. Sturmer, *Heterocyclic Compounds Special Topics in Heterocyclic Chemistry,* Chapter 8, Paragraph 4, pages 482–515 (John Wiley and Sons, New York, London, 1977).

The compounds having the formula (I) can be added to silver halide emulsions using conventional methods. Generally, the compounds are dissolved in a water-soluble solvent such as methanol, ethanol, pyridine, methyl cellosolve or acetone alone or a mixture thereof and then added to the silver halide emulsions. If desired, the compounds can be dissolved in a mixed solvent of the above organic solvent and water and then may be added to the silver halide emulsions.

The addition may be conducted in any stage during the course of the preparation of the silver halide emulsions. However, it is preferred that the addition of the compounds be carried out during or after the chemical ripening of the emulsion, or before or after the addition of stabilizers and anti-fogging agents.

The compound represented by formula (I) may be added to any layer of a magenta, cyan and yellow coupler-containing layers, however, usually, it is added to the cyan coupler containing layer.

Although there is no particular limitation with regard to the amount of the compounds represented by formula (I) to be used, the compounds are generally used in the range of $1\times10^{-6}$ to $1\times10^{-3}$ mol, more generally $1\times10^{-5}$ to $1\times10^{-4}$ mol per mol of silver halide.

Supersensitizing agents can be used in the present invention. Supersensitization is described in *Photographic Science and Engineering,* Vol. 13, pages 13–17 (1969), ibid., Vol. 18, pages 418–430 (1974) and James, *The Theory of the Photographic Process,* fourth edition, page 259 (McMillan, 1977). It is known that high sensitivity can be obtained when suitable sensitizing dyes and supersensitizing dyes are chosen.

Any supersensitizing agents can be used. However, compounds represented by the following general formula (II), which are disclosed in U.S. Pat. No. 4,822,726, are preferred.

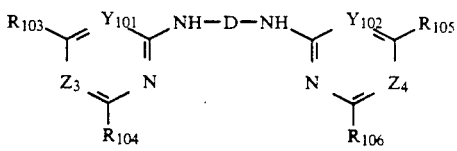

(II)

In the formula (II), D is a bivalent aromatic residue; $R_{103}$, $R_{104}$, $R_{105}$ and $R_{106}$, which may be the same or different, are each a hydrogen atom, a hydroxyl group, an alkoxy group, an aryloxy group, a halogen atom, a heterocyclic group (in the present invention a heterocyclic group or moiety is preferably a 5- or 7-membered heterocyclic group or moiety containing at least one of N, O, and S atoms as a hetero atom), a mercapto group, an alkylthio group, an arylthio group, a heterocyclic thio group, an amino group, an alkylamino group, a cyclohexylamino group, an arylamino group, a heterocyclic amino group, an aralkylamino group or an aryl group. These groups may be further substituted.

$Y_{101}$ and $Z_3$ are each —N= or —CH= and at least one of $Y_{101}$ and $Z_3$ is —N=.

$Y_{102}$ and $Z_4$ have the same meaning as $Y_{101}$ and $Z_3$.

Compounds having the formula (II) are illustrated in greater detail below.

D is a bivalent aromatic residue (e.g., a residue of a single aromatic nucleus; a residue of an aromatic nucleus wherein at least two aromatic nuclei are condensed; a residue of a group wherein at least two aromatic nuclei are bonded directly to each other or bonded to each other through an atom or atomic group; more specifically a residue having a biphenyl, naphthylene, stilbene or bibenzyl skeleton).

Groups represented by the following $D_1$ and $D_2$ are particularly preferred as D.

$D_1$;

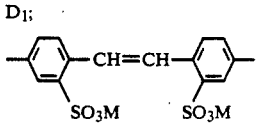

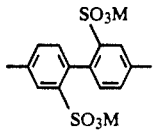

-continued

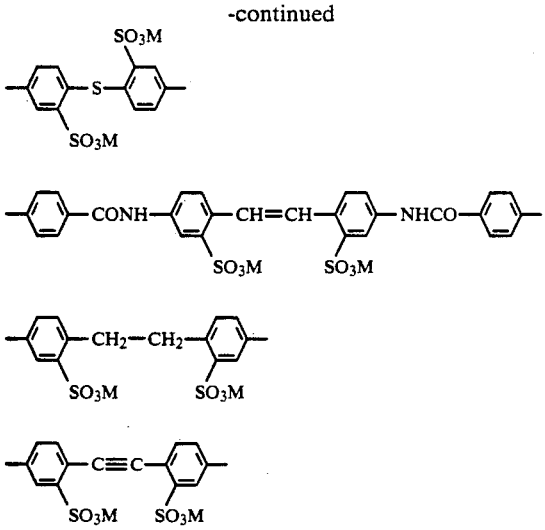

In the above formulas, M is a hydrogen atom or a cation [e.g., an alkali metal ion (Na, K, etc.), an ammonium ion, etc.] which renders the compounds water-soluble.

D2;

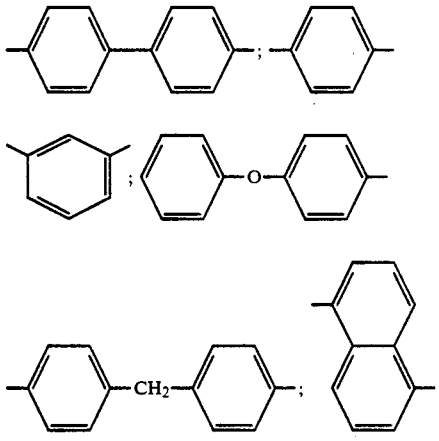

When D is $D_2$, at least one of $R_{103}$, $R_{104}$, $R_{105}$ and $R_{106}$ has a substituent group having $SO_3M$ (wherein M is as defined above).

$R_{103}$, $R_{104}$, $R_{105}$ and $R_{106}$ are each a hydrogen atom, a hydroxyl group, an alkoxy group (e.g., methoxy, ethoxy), an aryloxy group (e.g., phenoxy, naphthoxy, o-tolyloxy, p-sulfophenoxy), a halogen atom (e.g., chlorine, bromine), a heterocyclic group (e.g., morpholinyl, piperidyl), a mercapto group, an alkylthio group (e.g., methylthio, ethylthio), an arylthio group (e.g., phenylthio, tolylthio), a heterocyclic thio group (e.g., benzthiazoylthio, benzimidazoylthio, phenyltetrazoylthio), an amino group, an alkylamino group (e.g., methylamino, ethylamino, propylamino, dimethylamino, diethylamino, dodecylamino, β-hydroxyethylamino, di-β-hydroxyethylamino, β-sulfoethylamino), a cyclohexylamino group, an arylamino group (e.g., anilino, o-, m- or p-sulfoanilino, o-, m- or p-chloroanilino, o-, m- or p-anisidino, o-, m- or p-toluidino, o-, m- or p-carboxanilino, hydroxyanilino, sulfonaphthylamino, o-, m- or p-aminoanilino, o-acetaminoanilino), a heterocyclic amino group (e.g., 2-benzthiazolylamino, 2-pyridylamino), an aralkylamino group (e.g., benzylamino), or an aryl group (e.g., phenyl).

Of the compounds having the formula (II), compounds where at least one of $R_{103}$ to $R_{106}$ is an aryloxy group, a heterocyclic thio group or a heterocyclic amino group are particularly preferred.

Typical examples of the compounds of the formula (II) include, but are not limited to, the following compounds.

(II-1) Disodium salt of 4,4'-bis[2,6-di(benzthiazolyl-2-thio)pyrimidine-4-ylamino]stilbene-2,2'-disulfonic acid (II-2) Disodium salt of 4,4'-bis[2,6-di(benzthiazolyl-2 amino)pyrimidine-4-ylamino]stilbene-2,2'-disulfonic acid (II-3) Disodium salt of 4,4'-bis[2,6-di(1-phenyltetrazolyl-5-thio)pyrimidine-4-ylamino]stilbene-2,2'-disulfonic acid (II-4) Disodium salt of 4,4'-bis[2,6-di(benzimidazolyl-2-thio)pyrimidine-4-ylamino]stilbene-2,2'-disulfonic acid (II-5) Disodium salt of 4,4'-bis[2-chloro-6-(2-naphthyloxy)pyrimidine-4-ylamino]biphenyl-2,2'-disulfonic acid (II-6) Disodium salt of 4,4'-bis[2,6-di(naphthyl-2-oxy)-pyrimidine-4-ylamino]stilbene-2,2'-disulfonic acid (II-7) Disodium salt of 4,4'-bis[2,6-di(naphthyl-2-oxy)-pyrimidine-4-ylamino]bibenzyl-2,2'-disulfonic acid (II-8) Disodium salt of 4,4'-bis[2,6-diphenoxypyrimidine-4-ylamino]stilbene-2,2'-disulfonic acid (II-9) Disodium salt of 4,4'-bis[2,6-diphenylthiopyrimidine-4-ylamino]stilbene-2,2'-disulfonic acid (II-10) Disodium salt of 4,4'-bis[2,6-dichloropyrimidine-4-ylamino]stilbene-2,2'-disulfonic acid (II-11) Disodium salt of 4,4'-bis[2,6-dianilinopyrimidine-4-ylamino]stilbene-2,2'-disulfonic acid (II-12) Disodium salt of 4,4'-bis[4,6-di(naphthyl-2-oxy)-triazine-2-ylamino]stilbene-2,2'-disulfonic acid (II-13) Disodium salt of 4,4'-bis[4,6-dianilinotriazine-2-ylamino]stilbene-2,2'-disulfonic acid (II-14) Disodium salt of 4,4'-bis(2,6-dimercaptopyrimidine-4-ylamino)biphenyl 2,2'-disulfonic acid (II-15) Disodium salt of 4,4'-bis[4,6-di(naphthyl-2-oxy)-pyrimidine-2-ylamino]stilbene-2,2'-disulfonic acid (II-16) Disodium salt of 4,4'-bis[4,6-di(benzthiazolyl-2-thio)pyrimidine-2-ylamino]stilbene-2,2'-disulfonic acid (II-17) Disodium salt of 4,4'-bis[4,6-di(1-phenyltetrazolyl-2-amino)pyrimidine-2-ylamino]-stilbene-2,2'-disulfonic acid (II-18) Disodium salt of 4,4'-bis[4,6-di(naphthyl-2-oxy)-pyrimidine-2-ylamino]bibenzyl-2,2'-di-sulfonic acid The addition of the compound (I) and the compound (II) to an emulsion may be conducted in any order or simultaneously. If desired, a mixed solution of the compound (I) and the compound (II) may be added.

The compounds (II) are used in an amount of $1\times10^{-6}$ to $1\times10^{-1}$ mol, preferably $5\times10^{-5}$ to $1\times10^{-2}$ mol, per mol of silver halide. The ratio of the compound (I) to the compound 1(II) is in the range of preferably from 1/50 to 10/1 by mol.

Any of silver bromide, silver iodobromide, silver iodochlorobromide, silver chlorobromide and silver chloride can be used as the silver halide in the present invention. Silver chloride and a silver chlorobromide having a silver chloride content of not lower than 90 mol % (preferably not lower than 98 mol %) is preferred when rapid processing is to be conducted. Silver chlorobromide may contain a small amount of silver iodide, but it is preferred that silver chlorobromide is free from silver iodide.

Although there is no particular limitation with regard to the mean grain size (when the grain is spherical or nearly spherical, the mean grain size is the average of grain diameters, while when the grain is cubic, edge length is referred to as grain size and the mean grain size is determined from the average of the projected areas) of the silver halide grains in the photographic emulsions, the mean grain size is preferably not larger than 2 μm, particularly preferably from 0.2 to 1.5 μm.

The silver halide grains in the photographic emulsions may have a regular crystal form such as cube, tetradecahedron or octahedron (normal crystal emulsion) form, an irregular crystal form such as that of a sphere or a tabular or a composite form of these crystal forms. A mixture of grains having various crystal forms can be used, but it is preferred to use grains having a regular crystal form.

An emulsion wherein tabular (plate-form) grains having a diameter of at least 5 times its thickness account for at least 50% of the entire projected area of grains may be used.

The silver halide emulsion to be incorporated in at least one layer of the sensitive layers is a monodisperse emulsion having a coefficient of variation (a value (percentage) obtained by dividing the statistical standard deviation by the mean grain size) of not higher than 15%, more preferably not higher than 10%.

The monodisperse emulsion alone may be an emulsion having a coefficient of variation within the range defined above. An emulsion composed of a mixture of two or more monodisperse emulsions having different mean grain sizes and a coefficient of variation of not higher than 15%, preferably not higher than 10%, with these monodisperse emulsions being separately prepared, may be used.

A difference in grain size between two or more monodisperse emulsions and the mixing ratio thereof may be arbitrarily chosen, but it is preferred that the difference in mean grain size is in the range of 0.2 μm to 1.0 μm.

The definition of the coefficient of variation and method for measuring the same are described in T. H. James, *The Theory of the Photographic Process* (The MacMillan Company), third edition, page 39 (1966).

The silver halide grains may have different phases between the interior thereof and the surface layer thereof. Grains wherein a latent image is mainly formed on the surfaces thereof, or grains wherein a latent image is mainly formed in the interiors thereof can be used. The latter is useful as a direct positive emulsion.

Cadmium salts, zinc salts, thallium salts, lead salts, iridium salts or its complex salts, rhodium salts or its complex salts, iron salts or its complex salts may be present during the course of the formation of the silver halide grains or physical ripening.

Silver halide emulsions are generally subjected to chemical sensitization. Any conventional chemical sensitization methods can be used. Chemical sensitization-lis described in detail in JP-A-62-215272, page 12, the third column, line 18 to the fourth column, line 16.

Silver halide emulsions are generally subjected to spectral sensitization. Usually, conventional methine dyes can be used for spectral sensitization. The details thereof are described in JP-A-62-215272, page 22, the second column, lines 3 to 38 and an attached sheet (B) in an amendment dated Mar. 16, 1978.

The photographic emulsions of the present invention may contain various compounds to prevent fogging from occurring during the preparation or storage of the photographic materials or during processing or to stabilize photographic performance. Examples of suitable anti-fogging agents and stabilizers include azoles such as benzthiazolium salts, nitroimidazoles, nitrobenzimidazoles, chlorobenzimidazoles, bromobenz imidazoles, mercaptothiazoles, mercaptobenzthiazoles, mercaptobenzimidazoles, mercaptothiadiazoles, aminotriazoles, benztriazoles, nitrobenztriazoles, mercaptotetrazoles (particularly, 1-phenyl-5-mercaptotetrazole), mercaptopyrimidines and mercaptotriazines; thio keto compounds such as oxadolinethione; azaindenes such as triazaindenes, tetrazaindenes (particularly, 4-hydroxy-substituted (1,3,3a,7)tetrazaindene) and pentazaindenes; and benzenethiosulfonic acid, benzenesulfinic acid and benzenesulfonamide.

Couplers which can be used in the present invention are illustrated below.

The photographic materials of the present invention contain various couplers. The term "coupler" as used herein refers to a compound capable of forming a dye by a coupling reaction thereof with the oxidation product of aromatic primary amine developing agents. Typical examples of useful color couplers include naphthol or phenol compounds, pyrazolone or pyrazoloazole compounds and ring-open or heterocyclic keto methylene compounds. Examples of cyan, magenta and yellow couplers which can be used in the present invention are described in *Research Disclosure* (RD) 17643, Item VII-D (December, 1978), ibid., 18717 (November, 1979) and the patent references cited therein.

It is preferred that the color couplers which are used in the present invention be non-diffusing by the introduction of ballast group or by polymerization. When two equivalent type color couplers substituted at the position of an elimination group are used, the amount of silver to be coated ca be reduced in comparison with that required for four equivalent type color couplers where the coupling active site is a hydrogen atom. Couplers forming a color dye which is properly diffusing, non-color forming couplers, DIR couplers which release a restrainer by a coupling reaction, or couplers which release a development accelerator can also be used.

Typical examples of yellow couplers which can be used in the present invention include oil protect type acylacetamide couplers. Examples thereof are described in U.S. Pat. Nos. 2,875,057 and 3,265,506. Two equivalent type yellow couplers are preferred for the purpose of the present invention. Typical examples of these couplers include oxygen atom elimination type yellow couplers described in U.S. Pat. Nos. 3,408,194, 3,447,928, 3,933,501 and 4,022,620 and nitrogen atom elimination type yellow couplers described in JP-B-58-10739, U.S. Pat. Nos. 4,401,752 and 4,326,024, RD 18053 (April, 1979), U.K. Patent 1,425,020, West German Patent Laid-Open Nos. 2,219,917, 2,261,361, 2,329,587 and 2,433,812 and JP-A-62-240965. α-Pivaloylacetanilide couplers have excellent dye fastness, particularly fastness to light and α-benzoylacetanilide couplers provide high color density.

Examples of magenta couplers which can be used in the present invention include oil protect type indazolone couplers, cyanoacetyl couplers, preferably 5-pyrazolone couplers and pyrazoloazole couplers such as pyrazolotriazoles.

5-Pyrazolone couplers having an arylamino group or an acylamino group at the 3-position are preferred from the viewpoints of the hue and color density of the color forming dyes. Typical examples thereof are described in U.S. Pat. Nos. 2,311,082, 2,343,703, 2,600,788, 2,908,573, 3,062,653, 3,152,896 and 3,936,015. Nitrogen atom elimination groups described in U.S. Pat. No. 4,310,619 and arylthio groups described in U.S. Pat. No. 4,351,897 and WO(PCT) 88/04795 are preferred as the elimination groups of two equivalent type 5-pyrazolone couplers. 5-Pyrazolone couplers having ballast group described in European Patent 73,636 provide high color density.

Examples of pyrazoloazole couplers include pyrazolobenzimidazoles described in U.S. Pat. No. 3,369,879, preferably pyrazolo[5,1-c][1,2,4]triazoles described in U.S. Pat. No. 3,725,067, pyrazolotetrazoles described in *Research Disclosure* No. 24220 (June, 1984) and pyrazolopyrazoles described in *Research Disclosure* No. 24230 (June, 1984). Imidazo[1,2-b]pyrazoles described in European Patent 119,741 are preferred from the viewpoints of fastness to light and low degree of secondary yellow absorption and pyrazolo[1,5-b]1,2,4-triazole described in European Patent 119,860 is particularly preferred.

Typical examples of cyan couplers which can be used in the present invention include oil protect type naphthol couplers and phenol couplers. Specific examples of these naphthol couples include naphthol couplers described in U.S. Pat. No. 2,474,293 and preferably oxygen atom elimination type two equivalent type naphthol couplers described in U.S. Pat. Nos. 4,052,212, 4,146,396, 4,228,233 and 4,296,200. Specific examples of phenol couplers are described in U.S. Pat. Nos. 2,369,929, 2,801,171, 2,772,162 and 2,895,862. Cyan couplers with excellent fastness to moisture and temperature are preferred for the purpose of the present invention. Typical examples of such cyan couplers include phenol cyan couplers having an ethyl, group or a higher alkyl group at the meta-position of the phenol nucleus described in U.S. Pat. No. 3,772,002; 2,5-diacylamino substituted phenol couplers described in U.S. Pat. Nos. 2,772,162, 3,758,308, 4,126,396, 4,334,011 and 4,327,178, West German Patent Laid-Open No. 3,329,729 and U.S. Pat. No. 4,500,635; and phenol couplers having a phenylureido group at the 2-position and an acylamino group at the 5-position described in U.S. Pat. Nos. 3,446,622, 4,333,999, 4,451,559 and 4,427,767. Diphenylimidazole cyan couplers described in EP 0249453A2 can be also used.

Preferred examples of cyan couplers, magenta couplers and yellow couplers which can be used in the present invention include compounds represented by the following general formulas (VI), (VII), (VIII), (IX) and (X).

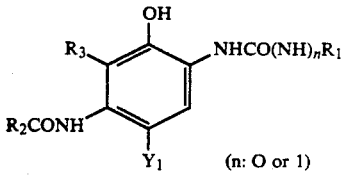

(VI)

(n: O or 1)

-continued

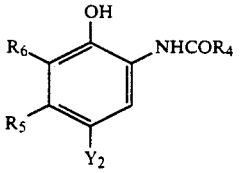

(VII)

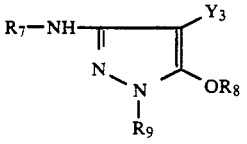

(VIII)

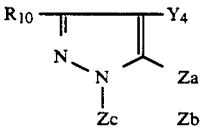

(IX)

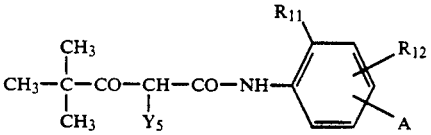

(X)

In the formula (VI) and (VII), $R_1$, $R_2$ and $R_4$, which may be the same or different, are each a substituted or unsubstituted aliphatic, aryl or heterocyclic group; $R_3$, $R_5$ and $R_6$, which may be the same or different, are each a hydrogen atom, a halogen atom, an aliphatic group, an aromatic group or an acylamino group; or R3 and R2 together represent a non-metallic atomic group which forms a nitrogen atom-containing five-membered or six-membered ring; and $Y_1$ and $Y_2$ are each a hydrogen atom or a group which is eliminated by a coupling reaction with the oxidation product of a developing agent. When $Y_1$ and $Y_2$ are each a group which is eliminated by a coupling (herein after referred to as elimination group), the elimination group is a group which bonds a coupling active carbon atom to an aliphatic group, an aromatic group, a heterocyclic group, an aliphatic, aromatic or heterocyclic sulfonyl group or an aliphatic, aromatic or heterocyclic carbonyl group through an oxygen, nitrogen or sulfur atom, or the elimination group is a halogen atom or an aromatic azo group. The aliphatic, aromatic or heterocyclic group in the elimination group may be substituted by one or more substituent groups suitable for $R_1$ above. When two or more substituent groups are present, they may be the same or different group. These substituent groups may have further one or more substituent groups allowable for $R_1$.

Examples of the aliphatic group having from 1 to 32 carbon atoms, which is represented by $R_1$, $R_2$ and $R_4$ in the cyan couplers having the formula (VI) or (VII), include methyl, butyl, tridecyl, cyclohexyl and allyl. Examples of aryl groups include phenyl and naphthyl. Examples of heterocyclic groups include 2-pyridyl, 2-imidazolyl, 2-furyl and 6 quinolyl. These groups may further be substituted by one or more substituent groups selected from an alkyl group, an aryl group, a heterocyclic group, an alkoxy group (e.g., methoxy, 2-methoxyethoxy), an aryloxy group (e.g., 2,4-di-tert-amylphenoxy, 2-chlorophenoxy, 4-cyanophenoxy), an alkenyloxy group (e.g., 2-propenyloxy), an acyl group (e.g., acetyl, benzoyl), an ester group (e.g., butoxycarbonyl, phenoxycarbonyl, acetoxy, benzoyloxy, butoxysulfonyl, toluenesulfonyl), an amido group (e.g., acetylamino, methanesulfonamido, dipropylsulfamoylamino), a carbamoyl group (e.g., dimethylcarbamoyl, ethylcarbamoyl), a sulfamoyl group (e.g., butylsulfamoyl), an imido group (e.g., succinimido, hydantoinyl), a ureido group (e.g., phenylureido, dimethylureido), an aliphatic or aromatic sulfonyl group (e.g., methanesulfonyl, phenylsulfonyl), an aliphatic or aromatic thio group (e.g., ethylthio, phenylthio), a hydroxyl group, a cyano group, a carboxyl group, a nitro group, a sulfo group and a halogen atom.

The groups $R_3$ and $R_5$ in the formulas (VI) and (VII) may be optionally substituted by one or more substituent groups already described above for $R_1$.

Preferably, $R_5$ in the formula (VII) is an aliphatic group such as methyl, ethyl, propyl, butyl, pentadecyl, tert-butyl, cyclohexyl, cyclohexylmethyl, phenylthiomethyl, dodecyloxyphenylthiomethyl, butaneamidomethyl and methoxymethyl.

In the formulas (VI) and (VII), $Y_1$ and $Y_2$ are each a hydrogen atom or a coupling elimination group (including coupling elimination atom; the same applies hereinbelow). Examples of the elimination groups include a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy), an aryloxy group (e.g., 4-chlorophenoxy, 4-methoxyphenoxy, 4-carboxyphenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloroacetylamino, heptafluorobutyrylamino, methanesulfonylamino, toluene-sulfonylamino), an alkoxycarbonyl group (e.g., ethoxycarbonyloxy, benzyloxycarbonyloxy), an aryloxycarbonyloxy group (e.g., phenoxycarbonyloxy), an aliphatic or aromatic thio group (e.g., ethylthio, phenylthio, tetrazolylthio), an imido group (e.g., succinimido, hydantoinyl) and an aromatic azo group (e.g., phenylazo). These elimination groups may include a photographically useful group.

Preferred examples of cyan couplers having the formula (VI) or (VII) are described below.

In the formula (VI), $R_1$ is preferably an aryl group or a heterocyclic group, more preferably an aryl group substituted by one or more of a halogen atom, an alkyl group, an alkoxy group, an aryloxy group, an acylamino group, an acyl group, a carbamoyl group, a sulfonamido group, a sulfamoyl group, an aliphatic or aromatic sulfonyl group, an aliphatic or aromatic oxycarbonyl group and a cyano group.

When $R_3$ and $R_2$ in the formula (VI) are not combined together to form a ring, $R_2$ is preferably a substituted or unsubstituted alkyl or aryl group, particularly preferably a substituted aryloxy-substituted alkyl group and $R_3$ is preferably hydrogen atom.

In the formula (VII), $R_4$ is preferably a substituted or unsubstituted alkyl or aryl group, particularly preferably a substituted aryloxy substituted alkyl group.

In the formula (VII), $R_5$ is preferably an alkyl group having from 2 to 15 carbon atoms or a methyl group having one or more substituent groups with one or more carbon atoms. Preferred substituent groups are an aryl thio group, an alkylthio group, an acylamino group, an aryloxy group and an alkyloxy group.

In the formula (VII), $R_5$ is more preferably an alkyl group having from 2 to 15 carbon atoms with an alkyl group having 2 to 4 carbon atoms being particularly preferred.

In the formula (VII), $R_6$ is preferably a hydrogen atom or a halogen atom with chlorine and fluorine being particularly preferred. In the formulas (VI), and (VII), $Y_1$ and $Y_2$ are preferably each a hydrogen atom, a halogen atom, an alkoxy group, an aryloxy group, an acyloxy group or an alipahtic or aromatic sulfonamido group.

In the formula (VII), it is preferred that $Y_2$ be a halogen atom, particularly chlorine or fluorine. When $n=0$ in the formula (VI), it is more preferred that $Y_1$ is a halogen atom, particularly chlorine or fluorine.

In the formula (VIII), $R_7$ and $R_9$ are each an aryl group; $R_8$ is a hydrogen atom, an aliphatic or aromatic acyl group or an aliphatic or aromatic sulfonyl group; and $Y_3$ is a hydrogen atom or an elimination group. The aryl group represented by $R_7$ or $R_9$ (which is preferably a phenyl group) may be substituted by one or more substituent groups already described above for $R_1$. When two or more substituent groups are present, they may be the same or different groups. $R_8$ is preferably a hydrogen atom, an aliphatic acyl group or a sulfonyl group with hydrogen being particularly preferred. Preferably, $Y_3$ is a group which is eliminated through a sulfur, oxygen or nitrogen atom with a sulfur atom elimination type being particularly preferred.

In the formula (IX), $R_{10}$ is a hydrogen atom or a substituent group;. $Y_4$ is a hydrogen atom or an elimination group; and Za, Zb and Zc are each a methine group, a substituted methine group, =N— or NH— and one of Za-Zb bond and Zb-Zc bond is a double bond and the other is a single bond. When the Zb-Zc bond is a carbon-to-carbon double bond, the bond may form part of an aromatic ring. A dimer or a polymer is formed by $R_{10}$ or $Y_4$, when Za, Zb or Zc is a substituted methine group, a dimer or a polymer can be formed by them.

Of the couplers having the formula (IX), the couplers represented by the following formulas (IXa), (IXb), (IXc), (IXd) and (IXe) are preferred.

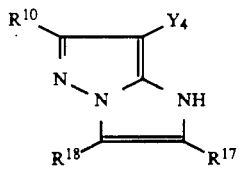

(IXa)

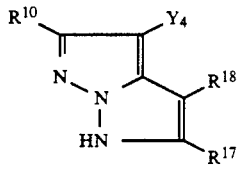

(IXb)

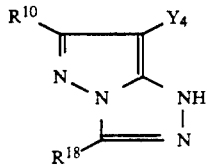

(IXc)

-continued

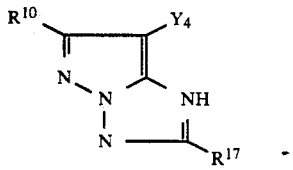

(IXd)

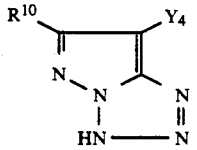

(IXe)

In the formulas (IXa) to (IXe), $R^{10}$ has the same meaning as that of $R^{10}$ in formula (IX), and $R^{10}$, $R^{17}$ and $R^{18}$, which may be the same or different, are each an aliphatic group, an aromatic group or a heterocyclic group. These groups may be substituted by one or more substituent groups already described above for $R_1$. Further, $R^{10}$, $R^{17}$ and $R^{18}$ may be RO—, $$\underset{\underset{O}{\|}}{RC}-,\ \underset{\underset{O}{\|}}{RCO}-,\ RS-,\ RSO_2-,\ RSO_2NH-,$$

$$\underset{\underset{O}{\|}}{RCNH}-,\ RNH-,\ \underset{\underset{O}{\|}}{ROCNH}-,$$

hydrogen atom, a halogen atom, cyano group or an imido group wherein R is an alkyl group, an aryl group or a heterocyclic group. Furthermore, $R^{10}$, $R^{17}$ and $R^{18}$ may be a carbamoyl group, a sulfamoyl group, a ureido group or a sulfamoyl group, and the nitrogen atom of these groups may be substituted by one or more substituent groups already described above for $R_1$. In addition, $R^{10}$, $R^{17}$ and $R^{18}$ or $Y_4$ may be a bivalent group to form a dimer, or $R^{10}$, $R^{17}$ and $R^{18}$ or $Y_4$ may be a bivalent group which bonds a high-molecular chain with the coupler chromophoric group.

Preferably, $R^{10}$, $R^{17}$ and $R^{18}$ are each a hydrogen atom, a halogen atom, an aliphatic group, an aromatic group, a heterocyclic group, RO—, RCONH—, $RSO_2NH$—, RNH—, RS or ROCONH— group where R is as described above. Preferably, $Y_4$ is a halogen atom, an acylamino group, an imido group, an aliphatic or aromatic sulfonamido group, a nitrogen-containing 5-membered or 6-membered N-containing heterocyclic group which is bonded to a coupling active site through a nitrogen atom, an aryloxy group, an alkoxy group, an arylthio group or alkylthio group.

In the formula (X), $R_{11}$ is a halogen atom or an alkoxy group; $R^{12}$ is a hydrogen atom, a halogen atom or an alkoxy group; A is $-NHCOR_{13}$, $-NHSO_2-R_{13}$, $-SO_2NHR_{13}$, $-COOR_{13}$ or $$-\underset{\underset{R_{14}}{|}}{SO_2N}-R_{13};$$

$R_{13}$ and $R_{14}$, which may be the same or different, are each an alkyl group; and $Y_5$ is an elimination group. $R_{12}$, $R_{13}$ and $R_{14}$ may be substituted by one or more substituent groups already described above for $R_1$. Preferably, $Y_5$ is a group selected from groups represented by the following formulas (Xa) to (Xg).

$$-OR_{20} \qquad \text{(Xa)}$$

In the formula (Xa), $R_{20}$ is an unsubstituted or substituted aryl group or an unsubstituted or substituted heterocyclic group.

(Xb)

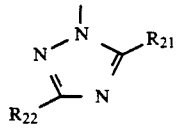

(Xc)

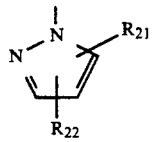

In the above formulas, $R_{21}$ and $R_{22}$, which may be the same or different groups, each is a hydrogen atom, a halogen atom, a carboxylic acid ester group, an amino group, an alkyl group, an alkylthio group, an alkoxy group, an alkylsulfonyl group, an alkylsulfinyl group, a carboxyl group, a sulfo group, an unsubstituted or substituted phenyl group or a heterocyclic group.

(Xd)

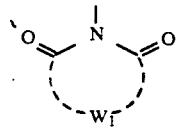

In the above formula, $W_1$ is a non-metallic atomic group required for the formation of a 4-membered, 5-membered or 6-membered ring.

Of the groups having the formula (Xd), the groups represented by the following formulas (Xe) to (Xg) are preferred.

(Xe)

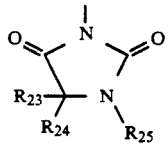

(Xf)

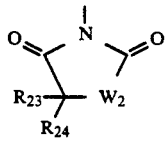

(Xg)

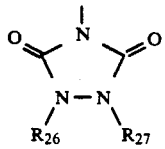

In the above formulas, $R_{23}$ and $R_{24}$, which may be the same or different, are each hydrogen atom, an alkyl group, an aryl group, an alkoxy group, an aryloxy group or hydroxyl group; $R_{25}$, $R_{26}$ and $R_{27}$, which may be the same or different, are each hydrogen atom, an alkyl group, an aryl group, an aralkyl group or an acyl group; and $W_2$ is an oxygen or sulfur atom.
These couplers are described in JP-A-63-11939. Preferred examples of these couplers include the following compounds.
(C-1)
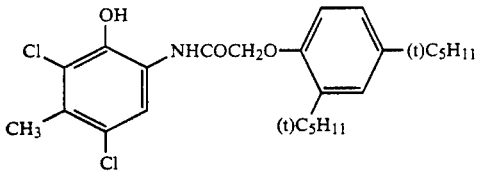
(C-2)
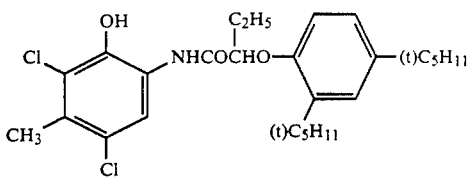
(C-3)
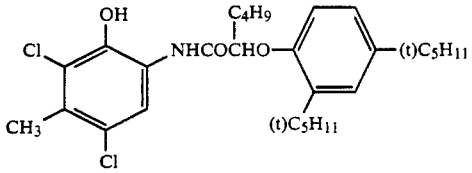
(C-4)
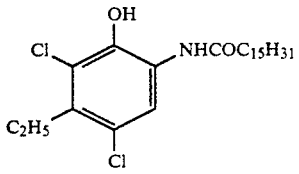
(C-5)
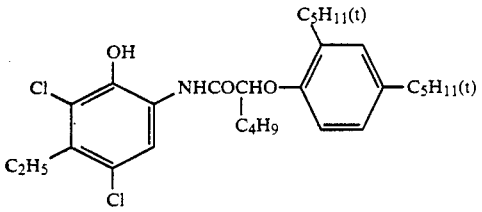
(C-6)
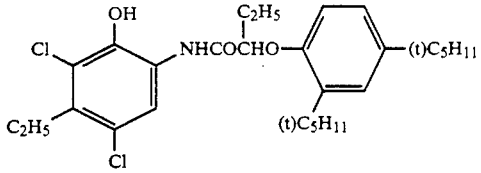
(C-7)
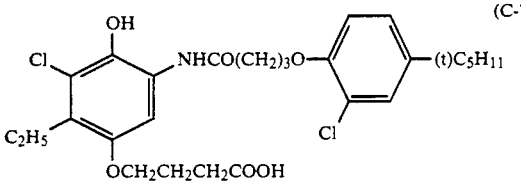
(C-8)
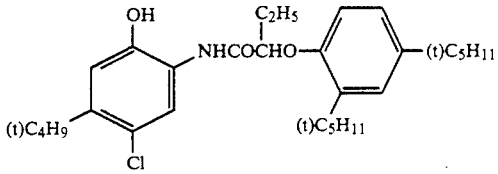
(C-9)
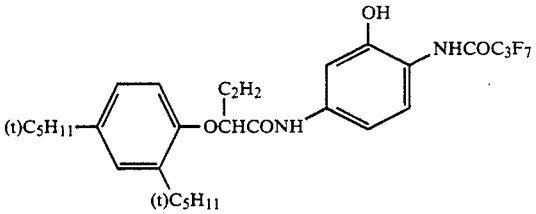
(C-10)
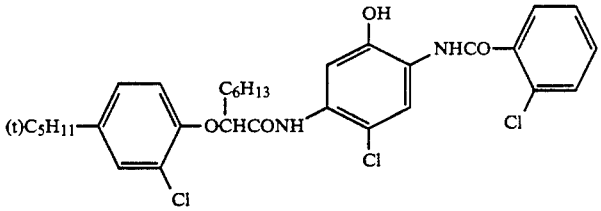
(C-11)
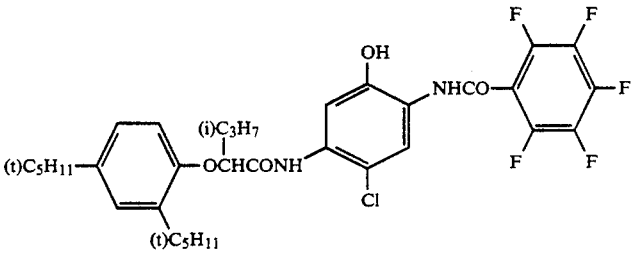

-continued
(C-12)
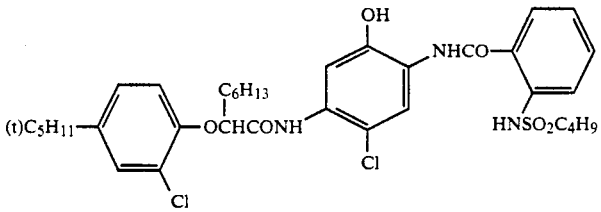
(C-13)
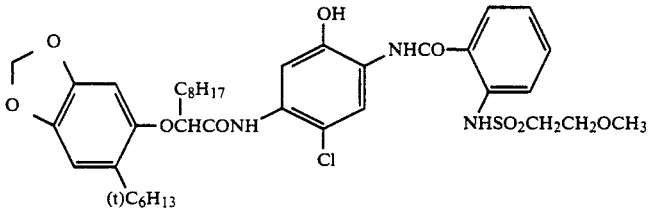
(C-14)
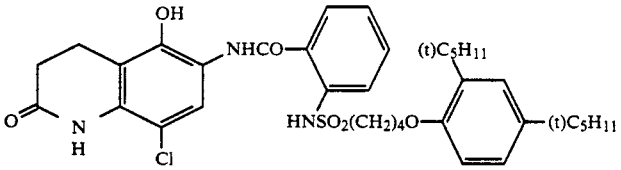
(C-15)
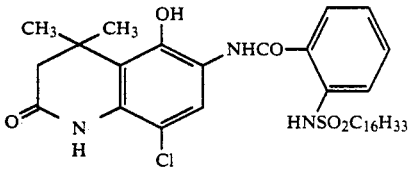
(C-16)
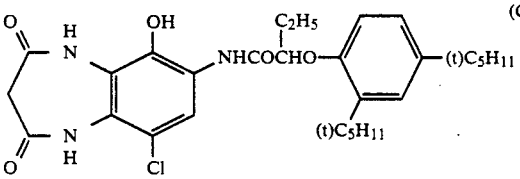
(C-17)
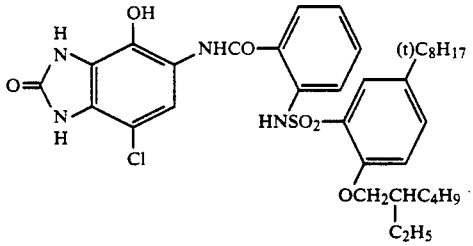
(C-18)
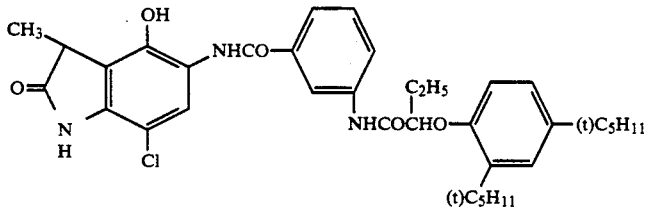
(C-19)
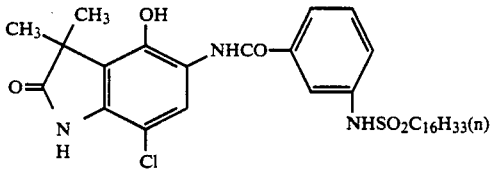

-continued
(C-20)
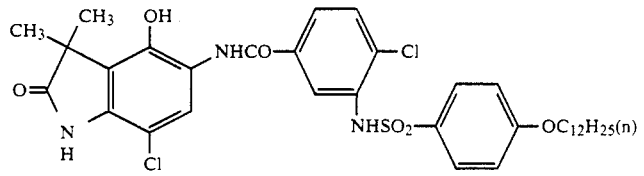
(C-21)
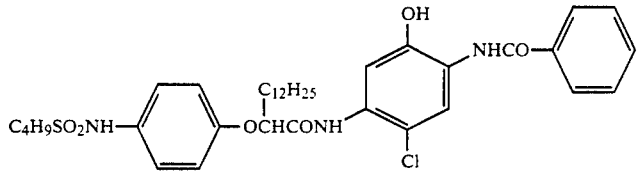
(C-22)
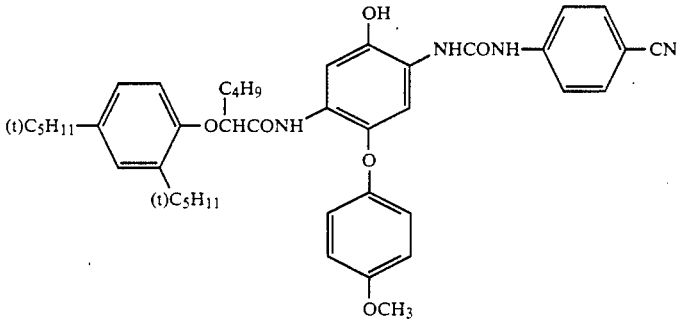
(M-1)
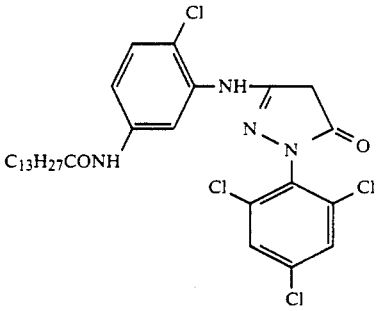
(M-2)
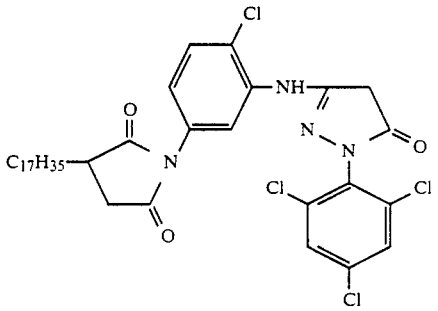
(M-3)
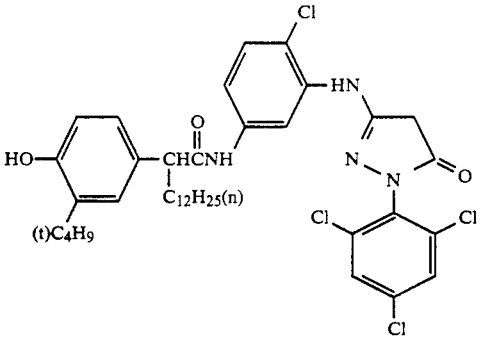
(M-4)
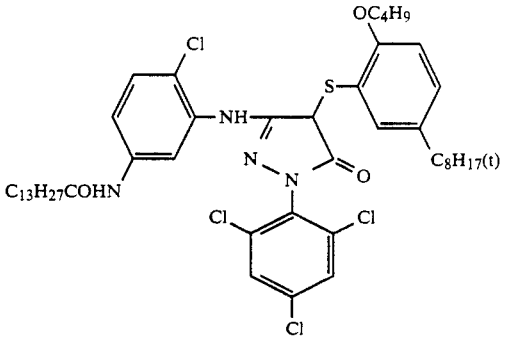
(M-5)
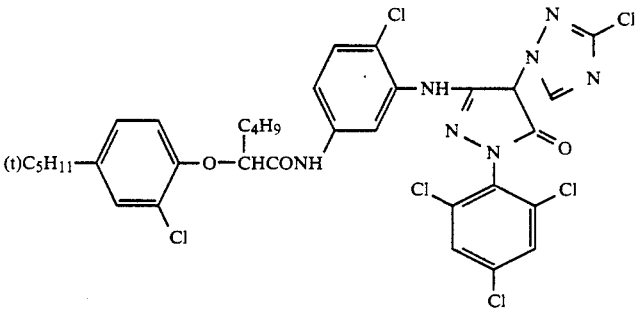

-continued
(M-6)
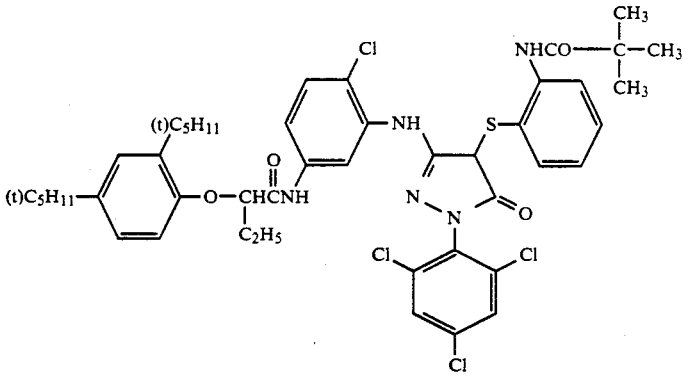
(M-7)
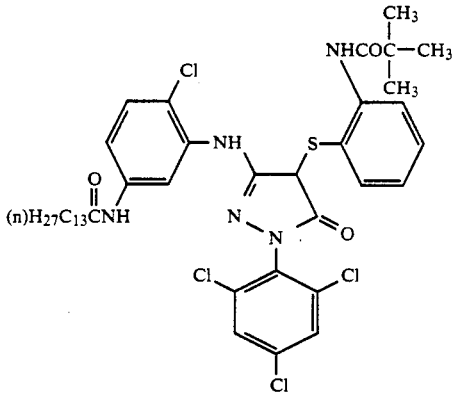
(M-8)
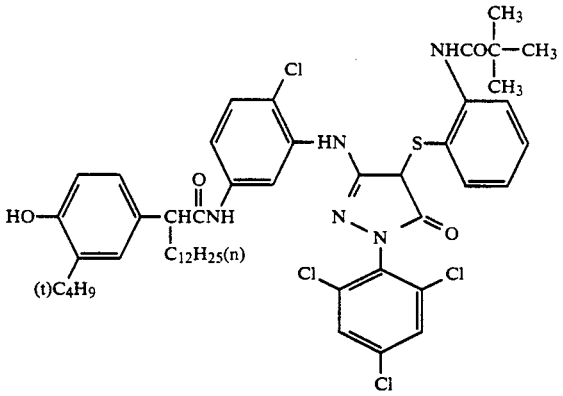
(M-9)
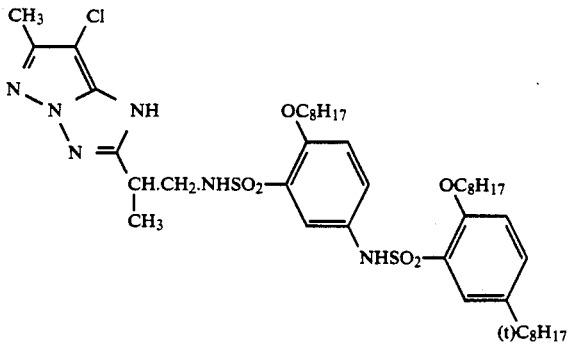

-continued
(M-10)
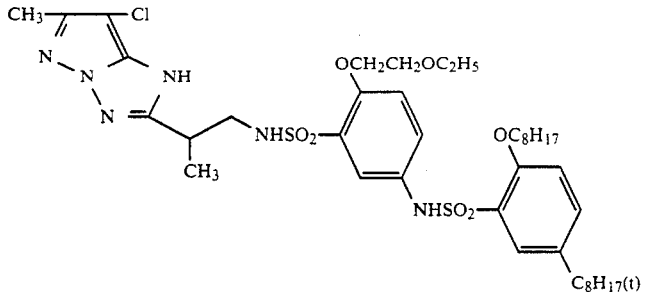
(M-11)
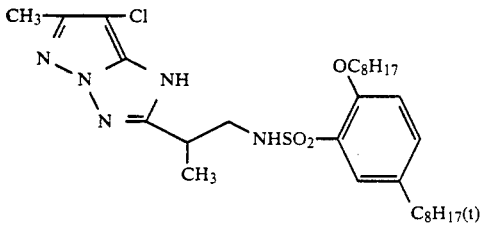
(M-12)
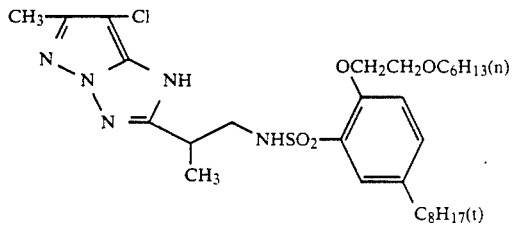
(M-13)
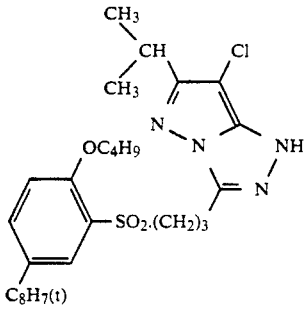
(M-14)
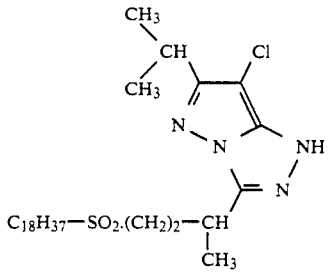
(M-15)
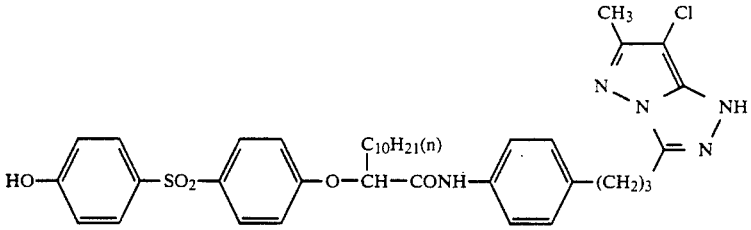
(M-16)
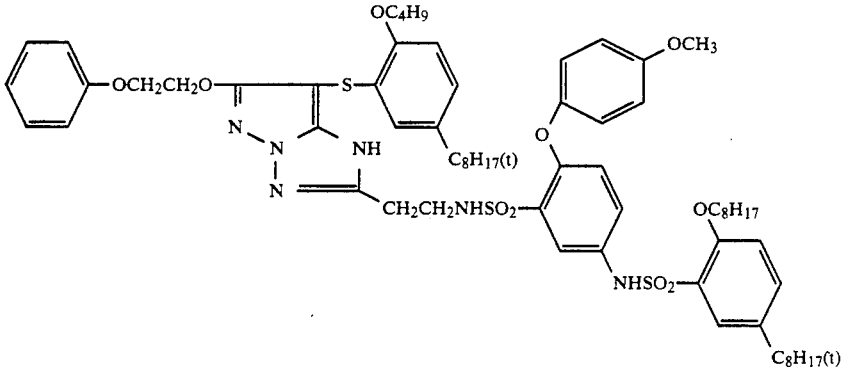

-continued
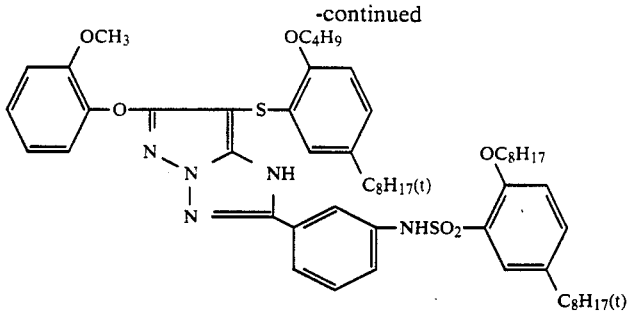
(M-17)
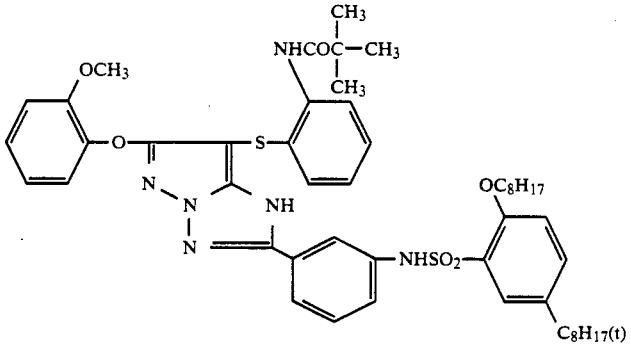
(M-18)
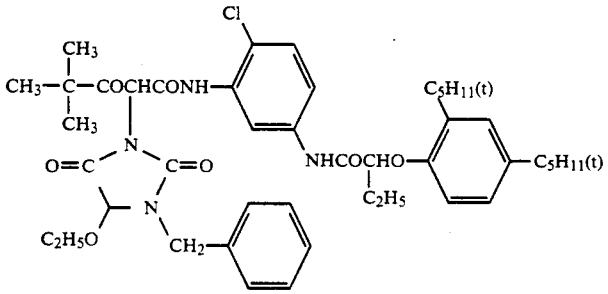
(Y-1)
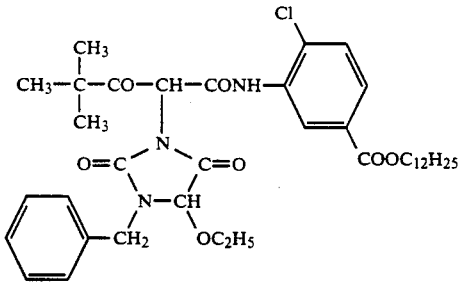
(Y-2)
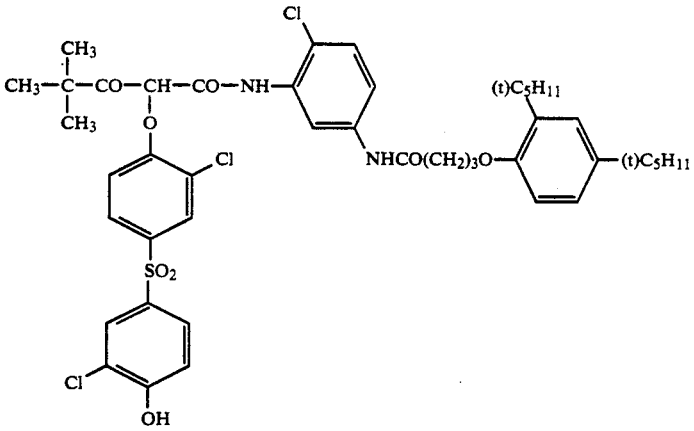
(Y-3)

-continued (Y-4)

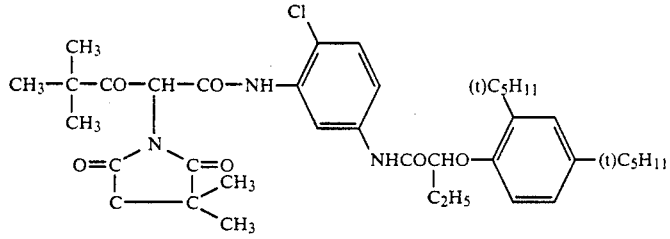

(Y-5)

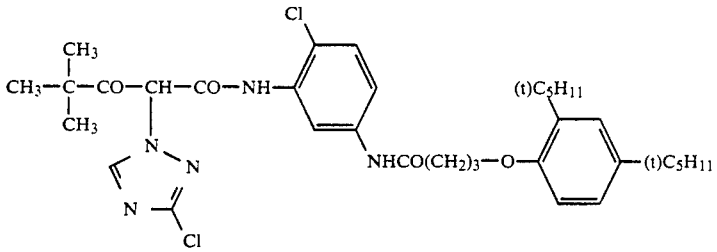

(Y-6)

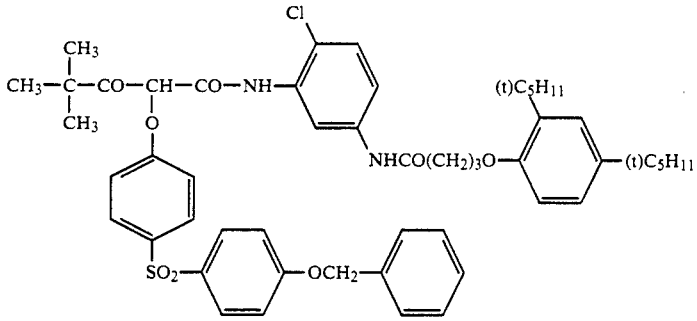

(Y-7)

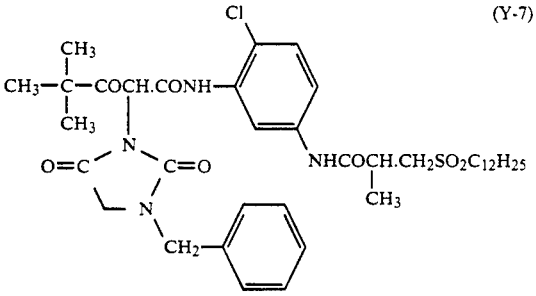

(Y-8)

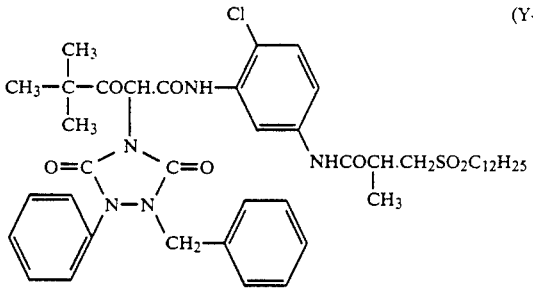

The couplers having the formulas (VI), (VII), (VIII), (IX) and (X) are used in an amount of 0.1 to 1.0 mol, preferably 0.1 to 0.5 mol, per mol of silver halide in the silver halide emulsion layers forming the sensitive layers.

The couplers can be added to the sensitive layers using conventional methods. Generally, the couplers are added using an oil-in-water dispersion method known as an oil protect method wherein the couplers are dissolved in a solvent and the resulting solution is emulsified and dispersed in an aqueous gelatin solution containing a surfactant. Alternatively, water or an aqueous gelatin solution is added to a coupler solution containing a surfactant and phase reversal is carried out to form an oil-in-water dispersion. Alkali-soluble couplers can be dispersed using a Fischer's dispersion method. (In this method an oil may be added in order to satisfy the definition of the present invention.) A low-boiling organic solvent is removed from: a coupler dispersion by distillation, noodle water washing or ultrafiltration and the coupler dispersion may be then mixed with the photographic emulsion.

Water-insoluble high-molecular weight compounds and/or high-boiling point organic solvents (both of them may form droplets) having a dielectric constant of 2 to 20 (at 25° C.) and a refractive index of 1.3 to 1.7 (at 25° C.) is preferably used as dispersion mediums for the couplers.

Compounds represented by the following formulas (A) to (E) are preferred as high-boiling point organic solvents. These compounds preferably are water-immiscible and have a melting point of not higher than 100° C., and a boiling point of not lower than 140° C.

(A)

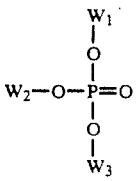

-continued

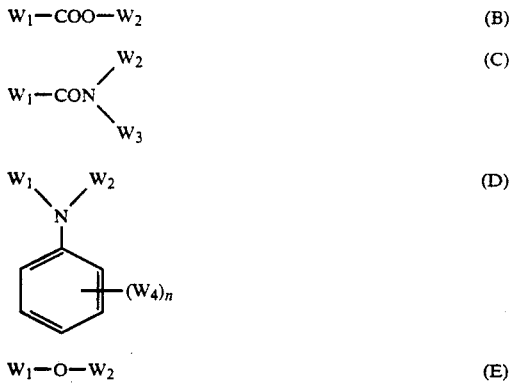

In the above formulas, $W_1$, $W_2$ and $W_3$, which may be the same or different, are each a substituted or unsubstituted alkyl, cycloalkyl, alkenyl, aryl or heterocyclic group; $W_4$ is $W_1$, $OW_1$ or $SW_1$; and n is an integer of from 1 to 5. When n is 2 or greater, two $W_4$ groups may be the same or different groups. In the formula (E), $W_1$ and $W_2$ may combine together to form a condensed ring.

In addition to the above-described high-boiling point organic solvents having the formulas (A) to (E), water-immiscible compounds having a melting point of not higher than 100° C. and a boiling point of not lower than 140° C., can be used so long as they are good solvents for the couplers. The high-boiling organic solvents have a melting point of preferably not higher than 80° C. and a boiling point of preferably not lower than 160° C., more preferably not lower than 170° C.

Examples of high-boiling point organic solvents having a boiling point of not lower than 160° C. include alkyl phthalates (e.g., dibutyl phthalate, dioctyl phthalate), phosphoric esters (e.g., diphenyl phosphate, triphenyl phosphate, tricresyl phosphate, dioctyl butyl phosphate), citric esters (e.g., tributyl acetylcitrate), benzoic esters (e.g., octyl benzoate), alkylamides (e.g., diethyllaurylamide), fatty acid esters (e.g., dibutoxyethyl succinate, dioctyl azelate) and phenols (e.g., 2,4-di-t-amylphenol). Examples of the water-insoluble high-molecular weight compounds include vinyl polymers (including homopolymers and copolymers) derived from compounds described in JP-B-60-18978 (columns 18–21), acrylamides and methacrylamides as monomer components.

More specifically, examples thereof include polymethyl methacrylate, polyethyl methacrylate, polybutyl methacrylate, polycyclohexyl methacrylate and poly-t-butylacrylamide. If desired, low-boiling organic solvents having a boiling point of 30° to 150° C. such as lower alkyl acetates (e.g., ethyl acetate, butyl acetate), ethyl propionate, sec-butyl alcohol, methyl isobutyl ketone, β-ethoxyethyl acetate and methyl cellosolve acetate (singly or as a combination of two or more thereof) may be used together with the high-boiling organic solvents and/or the water-insoluble high-molecular weight compounds.

In the present invention, ultraviolet light absorbers can be added to various layers. Preferably, the ultraviolet light absorbers are incorporated in layers containing the compounds having the formula (VI) or (VII) or in adjoining layers. Ultraviolet light absorbers which can be used in the present invention are compounds described in, for example, *Research Disclosure,* 17643, item VIII-C. Preferred ultraviolet light absorbers are benztriazole derivatives represented by the following formula (XI).

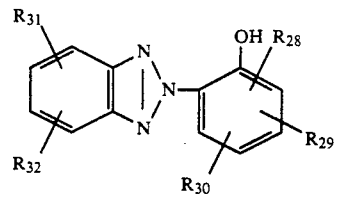

In the formula (XI), $R_{28}$, $R_{29}$, $R_{30}$, $R_{31}$ and $R_{32}$, which may be the same or different groups, each is a hydrogen atom, a halogen atom, a nitro group, a hydroxyl group, an alkyl group, an alkenyl group, an aryl group, an alkoxy group, an acyloxy group, an aryloxy group, an alkylthio group, an arylthio group, a mono- or dialkylamino group, an acylamino group or an oxygen-containing or nitrogen-containing 5-membered or 6-membered heterocyclic group and $R_{31}$ and $R_{32}$ may combine together to form a 5-membered or 6-membered aromatic ring composed of carbon atoms. Of these groups, groups, which can be substituted may be substituted by one or more substituent groups described above for $R_1$.

The compounds having the formula (XI) may be used either alone or as a mixture of two or more of them.

The compounds having the formula (XI) and a method for synthesizing these compounds are described in JP-B-44-29620, JP-A-50-151149, JP-A-54-95233, U.S. Pat. No. 3,766,205, EP 0057160, *Research Disclosure,* 22519 (1983, No. 225) and JP-A-61-190537. High-molecular weight ultraviolet light absorbers described in JP-A-58-111942, and JP-A-58-178351, JP-A-58-18104, JP-A-59-19945 and JP-A-59-23344 can be used. Further, low-molecular weight ultraviolet light absorbers and high-molecular weight ultraviolet light absorbers can be used in combination.

The ultraviolet light absorbers are dissolved in the high-boiling organic solvent and the low-boiling organic solvent (alone or in a combination of the solvents) as in the couplers and the resulting solution is dispersed in a hydrophilic colloid. Although there is no particular limitation with regard to the amounts of the high-boiling organic solvent and the ultraviolet light absorber, the high-boiling organic solvent is generally used in an amount of 0 to 300% by weight based on the amount of the ultraviolet light absorber. It is preferred that a compound which is liquid at room temperature or a mixture of such compounds is used together.

When the ultraviolet light absorbers having the formula (XI) are used in combination with the couplers of the present invention, the preservability (particularly, fastness to light) of the developed color image, particularly the cyan dye image can be improved. The ultraviolet light absorbers and cyan couplers may be co-emulsified.

The ultraviolet light absorbers may be used in an amount so as to acheive light stability of the cyan dye image. When the amounts of the ultraviolet light absorbers are too large, there is a possibility that the unexposed area (white part) of the color photographic material is yellowed. Accordingly, the ultraviolet light absorbers are used in an amount of preferably $1\times10^{-4}$ to $2\times10^{-3}$ mol/m$^2$, particularly $5\times10^{-4}$ to $1.5\times10^{-3}$ mol/m$^2$.

In conventional color paper photographic layer constitutions, the ultraviolet light absorber is incorporated in either one layer of both layers adjacent a red-sensitive emulsion layer containing a cyan coupler, preferably in both layers. When the ultraviolet light absorber is added to an intermediate layer between a green-sensitive layer and a red-sensitive layer, the ultraviolet light absorber may be co-emulsified together with color mixing inhibitor. When the ultraviolet light absorber is added to a protective layer, another protective layer as the outermost layer may be employed. The protective layer may contain a matting agent having an arbitrary particle size.

Various organic or metal complex type anti-fading agents may be used together to improve the preservability of the developed color image, particularly the yellow and magenta dye images. Examples of suitable organic anti-fading agents include hydroquinones, gallic acid derivatives, p-alkoxyphenols and p-hydroxyphenols. Dye image stabilizers, stain inhibitors or antioxidants are described in *Research Disclosure,* 17643, item VII-I to J and patent references cited therein. Metal complex type anti-fading agents are described in *Research Disclosure,* 15162.

Various compounds such as phenols, hydroquinones, hydroxychromans, hydroxycoumarans, hindered amines and their alkyl ethers and silyl ethers and hydrolyzable precursor derivatives can be used to improve fastness to heat and light of yellow dye image. Compounds represented by the following formulas (XVIII) and (XIX) are effective in improving the yellow dye image obtained from couplers having the formula (X) with regard to fastness to light as well as fastness to heat.

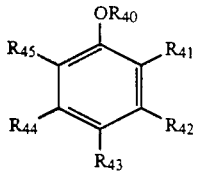

(XVIII)

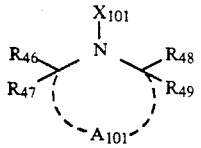

(XIX)

In the formulas (XVIII) and (XIX), $R_{40}$ is a hydrogen atom, an aliphatic group, an aromatic group, a heterocyclic group or a substituted silyl group or

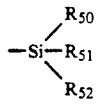

(wherein $R_{50}$, $R_{51}$ and $R_{52}$, which may be the same or different, each is an aliphatic group, an aromatic group, an aliphatic oxy group or an aromatic oxy group, each of which may be substituted by one or more substituent groups described above for $R_1$); $R_{41}$, $R_{42}$, $R_{43}$, $R_{44}$ and $R_{45}$, which may be the same or different, each is a hydrogen atom, an alkyl group, an aryl group, an alkoxy group, hydroxyl group, a mono- or dialkylamino group, an imino group or an acylamino group; $R_{46}$, $R_{47}$, $R_{48}$ and $R_{49}$, which may be the same or different, each is a hydrogen atom or an alkyl group; $X_{101}$ is a hydrogen atom, an aliphatic group, an acyl group, an aliphatic or aromatic sulfonyl group, an aliphatic or aromatic sulfinyl group, an oxy radical group or a hydroxyl group; and $A_{101}$ is a non-metallic atomic group required for the formation of a 5-membered, 6-membered or 7-membered ring.

Methods for synthesizing compounds having the formula (XVIII) or (XIX) or examples of other compounds are described in U.K. Patents 1,326,889, 1,354,313 and 1,410,846, U.S. Pat. Nos. 3,336,135 and 4,268,593, JP-B-51-1420, JP-B-52-6623, JP-A-58-114036 and JP-A-59-5246.

Compounds having the formulas (XVIII) and (XIX) may be used either alone or as a combination of two or more thereof. If desired, these compounds may be used in combination with anti-fading agents conventionally used.

The amount of the compounds (XVIII) and (XIX) to be used varies depending on the types of yellow couplers to be used in combination therewith, but is generally in the range of 0.5 to 200% by weight, preferably 2 to 150% by weight, based on the amounts of the yellow couplers for the purpose of the present invention. It is preferred that the compounds having the formula (XVIII) or (XIX) are co-emulsified with the yellow couplers having the formula (X).

The above-described dye image stabilizers, stain inhibitors or antioxidants are effective in improving the preservability of the magenta color images of the couplers represented by the formulas (VIII) and (IX). However, compounds represented by the following formulas (XX), (XXI), (XXII), (XXIII), (XXIV) and (XXV) are preferred, because fastness to light is greatly improved.

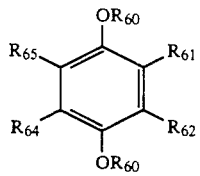

(XX)

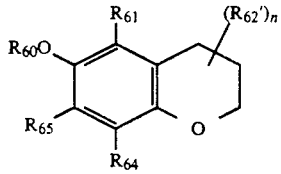

(XXI)

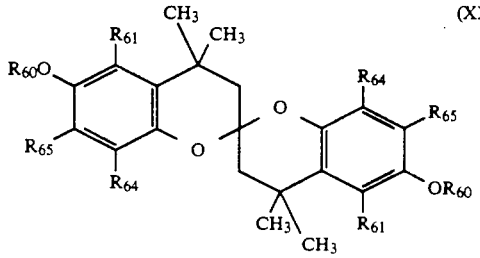

(XXII)

-continued

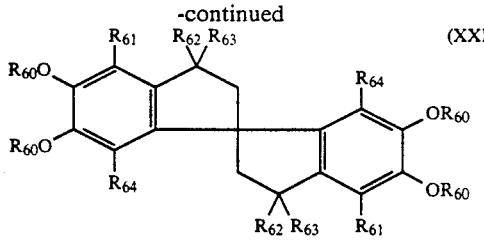

(XXIII)

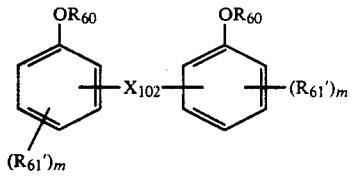

(XXIV)

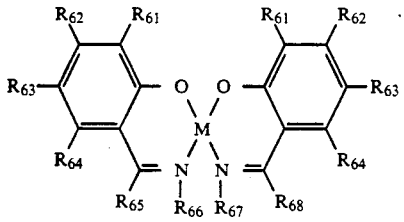

(XXV)

In the formulas (XX) to (XXV), $R_{60}$ has the same meaning as $R_{40}$ in the formula (XVIII); $R_{61}$, $R_{62}$, $R_{64}$ and $R_{65}$, which may be the same or different, each is a hydrogen atom, an aliphatic group, an aromatic group, an acylamino group, a mono- or dialkylamino group, an aliphatic or aromatic thio group, an acylamino group, an aliphatic or aromatic oxycarbonyl group or —$OR_{40}$; $R_{40}$ and $R_{61}$ may combine together to form a 5-membered or 6-membered ring and $R_{61}$ and $R_{62}$ may combine together to form a 5-membered or 6-membered ring; $X_{102}$ is a bivalent bonding group; $R_{66}$ and $R_{67}$, which may be the same or different, each is a hydrogen atom, an aliphatic group, an aromatic group or hydroxyl group; $R_{68}$ is a hydrogen atom, an aliphatic group or an aromatic group; $R_{66}$ and $R_{6}$; may combine together to form a 5-membered or 6-membered ring; M is Cu, Co, Ni, Pd or Pt; n is an integer of 0 to 3; m is an integer of 0 to 4 and m and n represent each the number of substituents and when m or n is 2 or greater, $R_{62}$ or $R_{61}$ may be the same or different groups. The aliphatic group or the aromatic group represented by $R_{61}$ to $R_{68}$ may be substituted by one or more substituent groups described above for $R_1$. $R'_{61}$ and $R'_{62}$ have the same meaning as $R_{61}$ and $R_{62}$ excluding the case wherein $R'_{61}$ and $R'_{62}$ each represents a hydrogen atom.

In the formula (XXIV), $X_{102}$ is preferably a group of the formulas

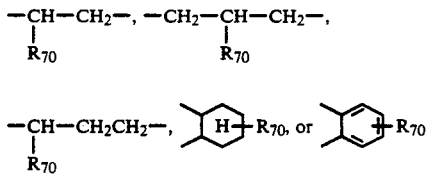

wherein $R_{70}$ is a hydrogen atom or an alkyl group.

In the formula (XXV), compounds where $R_{61}$ is a group capable of forming hydrogen bond and at least one of $R_{62}$, $R_{63}$ and $R_{64}$ is hydrogen atom, a hydroxyl group are preferred, an alkyl group or an alkoxy group. It is preferred that the total of the carbon atoms in each $R_{61}$ to $R_{68}$ is not less than 4 carbon atoms.

These compounds, methods for synthesizing the same and other compounds are described in U.S. Pat. Nos. 3,336,135, 3,432,300, 3,573,050, 3,574,627, 3,700,455, 3,764,337, 3,935,016, 3,982,944, 4,254,216 and 4,279,990, U.K. Patents 1,347,556, 2,062,888, 2,066,975 and 2,077,445, JP-A-60-97353, JP-A-52-152225, JP-A-53-17729, JP-A-53-20327, JP-A-54-145530, JP-A-55-6321, JP-A-55-21004, JP-A-58-24141, JP-A-59-10539, JP-B-48-31625 and JP-B-54-12337.

Compounds having the formula (XX) to (XXIV) are used in an amount of 10 to 200 mol %, preferably 30 to 100 mol %, based on the amount of the magenta coupler. Compounds having the formula (XXV) are used in an amount of 1 to 100 mol %, preferably 5 to 40 mol %, based on the amount of the magenta coupler. It is preferred that these compounds are co-emulsified with magenta coupler.

JP-A-49-11330 and JP-A-50-57223 disclose methods wherein dye image is surrounded by an oxygen barrier layer composed of a material having a low oxygen transmission rate to prevent fading from occurring. JP-A-56-85747 discloses a method wherein a layer having an oxygen transmission rate of not higher than 20 $ml/m^2.hr.$ atom is provided on the support side of the dye image forming layer of color photographic material. These methods can be employed in the present invention.

It is preferred that the following compounds are used together with the above-described couplers, particularly pyrazoloazole couplers.

Namely, a compound (Q) and/or a compound (R) are/is used alone or in combination, the compound (Q) being chemically bonded to an aromatic amine developing agents remained after color development to form a compound which is chemically inactive and substantially colorless and the compound (R) being chemically bonded to the oxidation product of aromatic amine developing agents remained after color development to form a compound which is chemically inactive and substantially colorless. When the compound (Q) and/or the compound (R) are/is used, stain can be prevented from being formed by the reaction of the coupler with the developing agent or its oxidation product remaining after processing and other side effects can be prevented from occurring.

As the compound (Q), preferred compounds are those having a second-order reaction constant $k_2$ (in triactyl phosphate at 80° C.) (in terms of the reaction with p-anisidine) of from 1.0 to $1\times10^{-5}$l/mol.sec. The second-order reaction constant can be measured by the method described in JP-A-63-158545.

When the constant $k_2$ exceeds the range defined above, the compounds themselves are unstable and there is a concern that they may react with gelatin or water and decomposed, while when the constant $k_2$ is smaller than the range defined above, the reaction thereof with the aromatic amine developing agents remained is retarded and there is a concern that the side effects of the aromatic amine developing agents cannot be prevented from occurring.

Among the compounds (Q), the compounds represented by the following formulas (QI) and (QII) are preferred.

$$R_{201}\text{-}(A_{201})_n\text{-}X_{201} \qquad \text{(QI)}$$

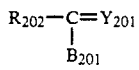

(QII)

In the above formulas, $R_{201}$ and $R_{202}$ are each an aliphatic group, an aromatic group or a heterocyclic group; n is 1 or 0; $A_{201}$ is a group which reacts with the aromatic amine developing agent to form a chemical bond; $X_{201}$ is a group which is eliminated on reaction with the aromatic amine developing agent; $B_{201}$ is a hydrogen atom, an aliphatic group, an aromatic group, a heterocyclic group, an acyl group or a sulfonyl group; $Y_{201}$ is a group which accelerates the addition of the aromatic amine developing agent to the compound having the formula (QII); and $R_{201}$ and $X_{201}$ or Y201 and $R_{202}$ or $B_{201}$ may combine together to form a ring structure.

Typical reaction systems of the compounds which are chemically bonded to the aromatic amine developing agents remained are substitution reactions and addition reactions.

Preferred examples of the compounds having the formulas (QI) and (QII) are. described in JP-A-63-158545, JP-A-62-283338, Japanese Patent Application Nos. 62-58342 and 63-18439.

Of the compounds (R) which are chemically bonded to the oxidation products of aromatic amine developing agents remained after color developing to form a compound which is chemically inactive and substantially colorless, the compounds represented by the following formula (RI) are preferred.

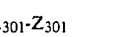

(RI)

In the above formula, $R_{301}$ is an aliphatic group, an aromatic group or a heterocyclic group; a and $Z_{301}$ is a nucleophilic group or a group which is decomposed in the photographic material to release a nucleophilic group. The compounds having the formula (RI) where $Z_{301}$ is a group having a Pearson's nucleophilic $^{n}CH_3I$ [R. G. Pearson, et al., *J. Am. Chem. Soc.*, 90, 319 (1968)] of 5 or above or a group derived therefrom are preferred.

Preferred examples of compounds having the formula (RI) are described in European Patent Laid-Open No. 255722, JP-A-62-143048, JP-A-62-229145, Japanese Patent Application Nos. 63-18439, 63-136724, 62-214681 and 62-158342.

Combinations of compounds (R) with compounds (Q) are described in detail in European Patent Laid-Open No. 277589.

The hydrophilic colloid layers of the photographic materials of the present invention may contain water-soluble dyes as filter dyes or for the purpose of preventing irradiation. Examples of such dyes include oxonol dyes, hemioxonol dyes, styryl dyes, merocyanine dyes, cyanine dyes and azo dyes. Among them, oxonol dyes, hemioxonol dyes and merocyanine dyes are particularly useful.

Dyes which are preferably used in the present invention are compounds represented by the following formulas (DI) to (DIII).

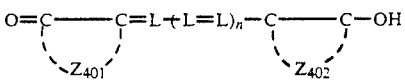

(DI)

In the above formula, $Z_{401}$ and $Z_{402}$, which may be the same or different groups, is a non-metallic atomic group required for the formation of a heterocyclic ring; L is methine group; and n is 0, 1 or 2.

The heterocyclic ring formed by a non-metallic atomic group represented by $Z_{401}$ or $Z_{402}$ is preferably a 5-membered or 6-membered ring which may be a monocyclic ring or a condensed ring. Examples of suitable heterocyclic rings include rings of 5-pyrazolone, barbituric acid, isoxazolone, thiobarbituric acid, rhodanine, imidazopyridine, pyrazolopyrimidine and pyrrolidone. These rings may be substituted.

Of the heterocyclic rings formed by $Z_{401}$ or $Z_{402}$, a 5-pyrazolone ring having at least one sulfo group or carboxyl group and a barbituric acid ring are preferred. Examples of oxonol dyes having a pyrazolone nucleus or barbituric acid nucleus are described in U.K. Patents 506,385, 1,177,429, 1,311,884, 1,338,799, 1,385,371, 1,467,214, 1,433,102 and 1,553,516, JP-A-48-85130, JP-A-49-114420, JP-A-55-161233, JP-A-59-111640, U.S. Pat. Nos. 3,247,127, 3,469,985 and 4,078,933.

The methine group represented by L may have one or more substituent groups (e.g., an alkyl group such as methyl or ethyl, an aryl group such as phenyl and a halogen atom such as chlorine). Two or more L groups may combine together to form a ring (e.g., 4,4-dimethyl-1-cyclohexene).

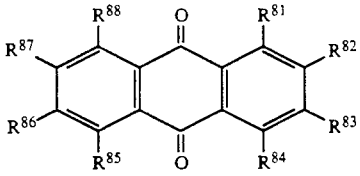

(DII)

In the above formula, $R^{81}$, $R^{84}$, $R^{85}$ and $R^{88}$, which may be the same or different, each is hydrogen atom, hydroxyl group, an alkoxy group, an aryloxy group, a carbamoyl group or an amino group

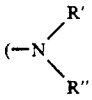

wherein R' and R'', which may be the same or different, each is a hydrogen atom, an alkyl group having at least one sulfo group or carboxyl group or an aryl group having at least one sulfo group or carboxyl group); and $R^{82}$, $R^{83}$, $R^{86}$ and $R^{87}$, which may be the same or different, each is a hydrogen atom, a sulfo group, a carboxyl group, an alkyl group having at least one sulfo group or carboxyl group or an aryl group having at least one sulfo group or carboxyl group.

(DIII)

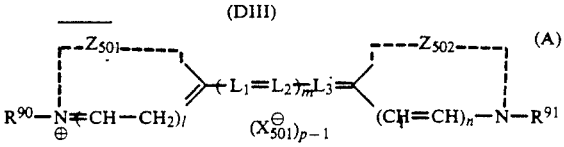

(A)

-continued or

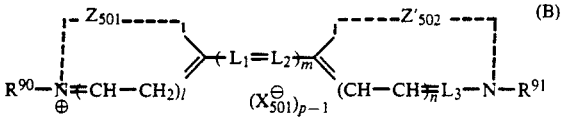

(B)

In the above formulas, $R^{90}$ and $R^{91}$, which may be the same or different, each is a substituted or unsubstituted alkyl group; $L_1$, $L_2$ and $L_3$, which may be the same or different, each is a substituted or unsubstituted methine groups described above; m is 0, 1, 2 or 3; $Z_{501}$ and $Z_{502}$, which may be the same or different, each is a non-metallic atomic group required for the formation of a substituted or unsubstituted 5-membered or 6-membered heterocyclic ring; l and n are each 0 or 1; $X^{\oplus}_{501}$ is an anion; and p is 1 or 2 and when the compounds form an inner salt, p is 1.

The above-described cyanine dyes are described in greater detail in U.S. Pat. 2,843,486 and 3,294,539.

Each of the blue-sensitive, green-sensitive and red-sensitive emulsions of the present invention is spectrally-sensitized with methine dyes or other dyes so as to impart color-sensitivity. Examples of suitable dyes which are used therefor include cyanine dyes, merocyanine dyes, complex cyanine dyes, complex merocyanine dyes, holopolar cyanine dyes, hemicyanine dyes, styryl dyes and hemioxonol dyes. Of these, particularly useful dyes are cyanine dyes, merocyanine dyes and complex merocyanine dyes. These dyes may contain any of the basic heterocyclic nuclei present in conventional cyanine dyes. Examples of such basic heterocyclic nuclei include a pyrroline nucleus, a oxazoline nucleus, a thiazoline nucleus, a pyrrole nucleus, a oxazole nucleus, a thiazole nucleus, a selenazole nucleus, an imidazole nucleus, a tetrazole nucleus, a pyridine nucleus, etc. Other examples of nuclei include those formed by fusing alicyclic hydrocarbon rings or aromatic hydrocarbon rings to the above-described nuclei, such as an indolenine nucleus, a benzindolenine nucleus, an indole nucleus, a benzoxazole nucleus, a naphthoxazole nucleus, a benzthiazole nucleus, a naphthothiazole nucleus, a benzselenazole nucleus, a benzimidazole nucleus and a quinoline nucleus. These nuclei may have one or more substituent groups on the carbon atoms thereof.

Merocyanine dyes or complex merocyanine dyes may have a nucleus having a keto-methylene structure. Examples of suitable nuclei include 5-membered or 6-membered heterocyclic nuclei such as a pyrazoline-5-one nucleus, a thiohydantoin nucleus, a 2-thiooxazolidine-2,4-dione nucleus, a thiazolidine-2,4-dione nucleus, a rhodanine nucleus and a thiobarbituric acid nucleus.

These sensitizing dyes may be used either alone or as a combination of two or more thereof. Combinations of sensitizing dyes are often used for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, U.K. Patents 1,344,281, 1,507,803, JP-B-43-4936, JP-B-53-12375, JP-A-52-110618 and JP-A-52-109925.

In addition to sensitizing dyes, the emulsions may contain a dye which itself does not have a spectral sensitizing action or a material which substantially does not absorb visible light, but exhibits supersensitization.

Gelatin is preferred as a binder or protective colloid for photographic emulsions. In addition thereto, other hydrophilic colloid can be used. For example, proteins such as gelatin derivatives, graft polymers of gelatin with other high-molecular materials, albumin and casein; cellulose derivatives such as hydroxyethyl cellulose, carboxymethyl cellulose and cellulose sulfate; saccharide derivatives such as sodium alginate and starch derivatives; and synthetic hydrophilic high-molecular materials (homopolymers or copolymers) such as polyvinyl alcohol, polyvinyl alcohol partial acetal, poly-N-vinyl-pyrrolidone, polyacrylic acid, polymethacrylic acid, polyacrylamide, polyvinylimidazole and polyvinyl pyrazole can be used.

Any of lime-processed gelatin and acid-processed gelatin can be used. The preparation of gelatin is described in greater detail in Arthur Weiss, *The Macromolecular Chemistry of Gelatin* (Academic Press 1964).

The term "reflection type support" as used herein refers to a support which enhances reflection properties to make a dye image formed on the silver halide emulsion layer clear. Examples of reflection type support includes supports coated with a hydrophobic resin containing a light reflecting material such as titanium oxide, zinc oxide, calcium carbonate or calcium sulfate dispersed therein and supports composed of a hydrophobic resin containing a light reflecting material dispersed therein. Typical examples of these supports include baryta paper, polyethylene coated paper, polypropylene synthetic paper, transparent supports (e.g., glass sheets, polyester films such as polyethylene terephthalate film and cellulose triacetate or cellulose nitrate, polyamide films, polycarbonate films, polystyrene films and vinyl chloride resins) coated with a reflecting layer or containing a reflection material. These supports can be appropriately chosen depending on the purpose of use.

It is preferred that, as the reflecting material, a white pigment is thoroughly kneaded in the presence of a surfactant or the surfaces of the pigment particles are treated with a dihydric to tetrahydric alcohol.

The occupied area ratio (%) of fine particles of white pigment per unit area can be determined by dividing the observed area into adjoining unit areas (one unit area: 6 $\mu m \times 6\ \mu m$) and measuring the occupied area ratio (%) (Ri) of the fine particles projected on the unit area. A coefficient of variation of the occupied area ratio (%) can be determined from the ratio ($S/\overline{R}$) of the standard deviation S of Ri to the mean value ($\overline{R}$) of Ri. The number (n) of divided unit areas is preferably not smaller than 6. Accordingly, the coefficient of variation $S/\overline{R}$ can be determined by the following formula.

$$\sqrt{\frac{\sum_{n=1}^{n} (Ri - R)^2}{n-1}} \Big/ \frac{\sum_{i=1}^{n} Ri}{n}$$

In the present invention, the coefficient of variation of the occupied area ratio (%) of the fine pigment particles is preferably not higher than 0.15, particularly not higher than 0.12. When the value is not higher than 0.08, it is considered that the dispersion of the particles is substantially uniform.

When hydrophilic colloid layers contain dyes or ultraviolet light absorbers in the present invention, cationic polymers may be used as mordants. For example, the polymers described in U.K. Patent 685,475, U.S. Pat. Nos. 2,675,316, 2,839,401, 2,882,156, 3,048,487, 3,184,309 and 3,445,231, West German Patent Application (OLS) No. 1,914,362, JP-A-50-47624 and JP-A-50-71332 can be used.

The photographic materials of the present invention may contain hydroquinone derivatives, aminophenol derivatives, gallic acid derivatives and ascorbic acid derivatives as color fogging inhibitors (anti-fogging agents). Examples of suitable anti-fogging agents are described in U.S. Pat. Nos. 2,360,290, 2,336,327, 2,403,721, 2,418,613, 2,675,314, 2,701,197, 2,704,713, 2,728,659, 2,732,300 and 2,735,765, JP-A-50-92988, JP-A-50-92989, JP-A-50-93928, JP-A-50-110387, JP-A-52-146235 and JP-B-50-23813.

If desired, fine silver halide grain emulsions (e.g., silver chloride, silver bromide or silver chlorobromide emulsion having a mean grain size of not larger than 0.20$\mu$) which are substantially not sensitive, may be added to the silver halide emulsion layers or other hydrophilic colloid layers.

The color developing solutions which can be used in the present invention are preferably aqueous alkaline solutions mainly composed of aromatic primary amine color developing agents. Aminophenol compounds are useful as color developing agents and p-phenylenediamine compounds are preferred as color developing agents. Typical examples thereof include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methane sulfonamidoethylaniline, 3-methyl-4-amino-N-ethyl-N-$\beta$methoxyethylaniline and salts thereof such as sulfate, hydrochloride and p-toluenesulfonate. These compounds may be used either alone or as a combination of two or more thereof.

Generally, the color developing solutions contain pH buffering agents such as alkali metal carbonates, borates and phosphates, restrainers or anti-fogging agents such as bromides, iodides, benzimidazoles, benzothiazoles and mercapto compounds. If desired, the color developing solutions may optionally contain preservatives such as hydroxylamine, diethylhydroxylamine, hydrazines, sulfites, phenylsemicarbazides, triethanolamine, catecholsulfonic acids and triethylenediamine (1,4-diazabicyclo[2,2,2]octane); organic solvents such as ethylene glycol and diethylene glycol; development accelerators such as benzyl alcohol, polyethylene glycol, quaternary ammonium salts and amines; color forming couplers, competitive couplers and fogging agents such as sodium boron hydride; auxiliary developing agents such as 1-phenyl 3-pyrazolidone; tackifiers; and chelating agents such as polyaminocarboxylic acids, aminopolyphosphonic acids, alkylphosphonic acids and phosphonocarboxylic acids, for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylene-diamine-N,N,N',N'-tetramethylenephosphonic acid and ethylenediamine-di(o-hydroxyphenylacetic acid) and the salts thereof.

Generally, when reversal processing is to be conducted, black-and-white development is first carried out and color development is then carried out. Black-and-white developing solutions may contain conventional developing agents such as hydroquinones (e.g., dihydroxybenzenes), 3-pyrazolidones (e.g., 1-phenyl-3-pyrazolidone) and aminophenols (e.g., N-methyl-p-aminophenol). These developing agents may be used either alone or as a combination of two or more of them.

The replenishment rate of these developing solutions varies depending on the type of color photographic materials, but is usually not more than 3 l per $m^2$ of the photographic material. The replenishment rate can be reduced to 500 ml or less when the concentration of bromide ion in the replenisher is reduced. When the replenishment is to be reduced, it is desirable that the opening area of the processing bath is reduced to prevent the solution from being evaporated or oxidized by air. The replenishment rate can be reduced by using a means for inhibiting the accumulation of bromide ion in the developing solution.

After color development, the photographic emulsion layer is generally bleached. Bleaching may be carried out simultaneously with fixing (bleaching-fixing treatment) and they can be separately carried out. After bleaching, a bleaching-fixing treatment may be conducted to expedite processing. Fixing may be conducted before the bleaching-fixing treatment or after the bleaching-fixing treatment bleaching may be conducted depending on the purpose. Examples of bleaching agents include compounds of polyvalent metals such as iron(III), cobalt(III), chromium(VI) and copper(II), peracids, quinones and nitro compounds. Typical examples of bleaching agents include ferricyanates; dichromates; organic complex salts of iron(III) or cobalt(III) such as complex salts of aminopolycarboxylic acids (e.g., ethylenediaminetetraacetic acid, diethylenetriaminepentaacetic acid, cyclohexanediamine tetraacetic acid, methyliminodiacetic acid, 1,3-diaminopropanetetraacetic acid, glycol ether diaminetetraacetic acid, etc.), citric acid, tartaric acid, malic acid, etc.; persulfates; bromates; permanganates; and nitrobenzenes. Of these, iron(III) complex salts of aminopolycarboxylic acids such as (ethylenediaminetetraacetonato)iron(III) complex and persulfates are preferred from the viewpoints of rapid processing and prevention of environmental pollution. Further, iron(III) complex salts of aminopolycarboxylic acids are useful for bleaching solutions and monobath bleaching-fixing solutions.

If desired, the bleaching solution, the bleaching-fixing solution and the prebath thereof may contain bleaching accelerators. Examples of suitable bleaching accelerators include compounds having a mercapto group or a disulfide group described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and *Research Disclosure* No. 17129 (July, 1978); thiazolidine derivatives described in JP-A-50-140129; thiourea derivatives described in JP-B-45-8506, JP-A-52-20832, JP-A-53-32735 and U.S. Pat. No. 3,706,561; iodides described in West German Patent 1,127,715 and JP-A-58-16235; polyoxyethylene compounds described in West German Patents 996,410 and 2,748,430; polyamine compounds described in JP-B-45-8836; compounds described in JP-A-49-42434, JP-A-49-59644, JP-A-53-94927, JP-A-54-35727, JP-A-55-26506 and JP-A-58-163940; and bromide ions. Of these, the compounds having a mercapto group or a disulfide group are preferred from the viewpoint of high acceleration effect. Particularly, the compounds described in U.S. Pat. No. 3,893,858, West German Patent 1,290,812 and JP-A-53-95630 are preferred. Further, the compounds described in U.S. Pat. No. 4,552,834 are preferred. These bleaching accelerators may be incorporated in the photographic materials.

Examples of fixing agents include thiosulfates, thiocyanates, thioether compounds, thioureas and iodides. Thiosulfates are widely used as fixing agents. Particularly, ammonium thiosulfate is most widely used. Sulfites, bisulfites and carbonyl bisulfite adducts are preferred as preservatives for .the bleaching-fixing solutions.

Usually, the silver halide color photographic materials of the present invention are subjected to washing and/or stabilization after desilvering. The amount of rinsing water in the washing stage widely varies depending on the characteristics (e.g., depending on materials used such as couplers) of the photographic materials, the use, the temperature of the rinsing water, the number of rinsing tanks (the number of stages), the replenishing system (countercurrent, direct flow) and other conditions. The relationship between the amount of water and the number of rinsing tanks in a multi-stage countercurrent system can be determined by the method described in *Journal of the Society of Motion Picture and Television Engineers,* Vol. 64, p. 248–253 (May, 1955).

Use of the multi-stage countercurrent system described in the above literature permits the amount of rinsing water to be greatly reduced. However, there is a problem that the residence time of water in the tanks is prolonged and as a result, bacteria can grow and the resulting suspended matter is deposited on the photographic material. A method for reducing the calcium ion and magnesium ion content described in JP-A-62-288838 can be effectively used for the color photographic materials of the present invention to solve the above-mentioned problem. Further, isothiazolone compounds, thiabendazole compounds, chlorine-containing germicides such as sodium chlorinated isocyanurate and benztriazole and germicides described in *Chemistry of Germicidal Antifungal Agents,* written by Hiroshi Horiguchi, *Sterilization, Disinfection, Antifungal Technique,* edited by Sanitary Technique Society and *Antibacterial and Antifungal Cyclopedie,* edited by Nippon Antibacterial Antifungal Society, can be used.

The pH of the rinsing water in the treatment of the photographic materials of the present invention generally is in the range of 4 to 9, preferably 5 to 8. The temperature of the rinsing water and the washing time vary depending on the characteristics of the photographic materials, the use, etc., but the temperature and time of washing are generally 15° to 45° C. for 20 seconds to 10 minutes, preferably 25° to 40° C. for 30 seconds to 5 minutes. The photographic materials of The present invention may be processed directly with stabilizing solutions in place of the rinsing water. This stabilizing treatment can be carried out using conventional methods described in JP-A-57-8543, JP-A-58-14834 and JP-A-60-220345.

A stabilizing treatment subsequent to the rinsing may be conducted. The stabilizing bath may contain various chelating agents and antifungal agents. Overflow solution from the replenishment of rinsing water and/or stabilizing can be reused in other stages such as desilverization stage.

The color developing agents may be incorporated in the silver halide color photographic materials of the present invention for the purpose of simplifying and expediting processing. It is preferred that precursors for the color developing agents are used for the incorporation thereof in the photographic materials. Examples of suitable precursors include indoaniline compounds described in U.S. Pat. No. 3,342,597; Schiff base silver compounds described in U.S. Pat. No. 3,342,599 *Research Disclosure* No. 14850 and ibid., No. 15159; aldol compounds described in *Research Disclosure* No. 13924; metal complex salts described in U.S. Pat. No. 3,719,492; and urethane compounds described in JP-A-53-135628.

If desired, 1-phenyl-3-pyrazolidones may be incorporated in the silver halide color photographic materials of the present invention for the purpose of accelerating color development. Typical examples of these compounds include those described in JP-A-56-64339, JP-A-57-144547 and JP-A-58-115438.

In the present invention, various processing solutions are used generally at a temperature of 10° to 50° C. Preferably, a temperature of 33° to 38° C. is used. However, it is possible for higher temperatures to be used to accelerate processing and to shorten the processing time, while a lower temperature is used to improve image quality and to improve the stability of the processing solutions. If desired, treatments using cobalt intensification or hydrogen peroxide intensification as described in West German Patent 2,226,770 and U.S. Pat. No. 3,674,499 may be carried out to save silver.

If desired, a heater, a temperature sensor, a liquid level sensor, a circulating pump, a filter, a floating cover, a squeezer, etc. may be provided within the various processing baths.

The present invention is now illustrated in greater detail by reference to the following examples which, however, are not to be construed as limiting the invention in any way. Unless otherwise indicated herein, all parts, percents, ratios and the like are by weight.

EXAMPLE 1

A silver halide emulsion (A) for a blue-sensitive silver halide emulsion layer was prepared in the following manner.

| | |
|---|---|
| Solution 1 | |
| $H_2O$ | 1000 ml |
| NaCl | 9.07 g |
| KBr | 0.07 g |
| Gelatin | 25.8 g |
| Sulfuric Acid (1 N) | 19.7 ml |
| Solution 2 | |
| Compound shown below (1% aqueous solution) | 3 ml |

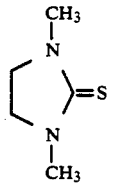

| | |
|---|---|
| Solution 3 | |
| KBr | 17.0 g |
| NaCl | 0.25 g |
| Add $H_2O$ | 129.3 ml |
| Solution 4 | |
| $AgNO_3$ | 25 g |

-continued

| | |
|---|---|
| $NH_4NO_3$ (50% aqueous solution) | 0.5 ml |
| Add $H_2O$ | 133.3 ml |
| Solution 5 | |
| KBr | 52.07 g |
| NaCl | 5.4 g |
| $K_2IrCl_6$ (0.001% aqueous solution) | 2.0 ml |
| Add $H_2O$ | 283.3 ml |
| Solution 6 | |
| $AgNO_3$ | 100 g |
| $NH_4NO_3$ (50% aqueous solution) | 1.5 ml |
| Add $H_2O$ | 286 ml |

Solution 1 was heated to 70° C. and Solution 2 was added thereto. Solution 3 and Solution 4 were simultaneously added thereto over a period of 40 minutes. Ten minutes later, Solution 5 and Solution 6 were simultaneously added thereto over a period of 25 minutes. Five minutes after the completion of the addition, the temperature was lowered and the solution was desalted. Water and gelatin for dispersion were added thereto and the pH of the mixture was adjusted to 6.15, thus obtaining a monodisperse cubic silver chlorobromide emulsion (A) having a silver bromide content of 79 mol %, a mean grain size of 0.88 μm and a coefficient of variation (s/d; a value obtained by dividing the standard deviation by mean grain size) of 0.06. The emulsion was chemically sensitized with triethylthiourea.

A silver halide Emulsion (B) for a blue-sensitive silver halide emulsion layer, silver halide Emulsions (C) and (D) for green-sensitive silver halide emulsion layers and silver halide Emulsions (E) and (F) for red-sensitive silver halide emulsion layers were prepared in the same manner as in the preparation of Emulsion (A) except that the amounts of reagents, temperature and time were changed to those given in the Table below.

The shapes, mean grain sizes, halogen compositions and coefficients of variation of the silver halide Emulsions (A) to (F) are shown in the following Table.

| Emulsion | Shape | Mean Grain Size (μm) | Halogen Composition (Br mol %) | Coefficient of Variation |
|---|---|---|---|---|
| (A) | Cube | 0.88 | 79 | 0.06 |
| (B) | Cube | 0.65 | 80 | 0.06 |
| (C) | Cube | 0.46 | 90 | 0.09 |
| (D) | Cube | 0.35 | 90 | 0.09 |
| (E) | Cube | 0.48 | 74 | 0.10 |
| (F) | Cube | 0.34 | 74 | 0.10 |

A paper support (both sides thereof being laminated with polyethylene) was coated with the following layers to prepare a multi-layer Color Photographic Material (101) having the following layer structure.

Coating solutions were prepared in the following manner.

Preparation of Coating Solution for First Layer 19.1 g of Yellow Coupler (ExY), 0.17 g of Anti-Fogging Agent (Cpd-1) and 1.91 g of Dye Image Stabilizer (Cpd-2) were dissolved in 29.9 ml of ethyl acetate, 3.8 ml of Solvent (Solv-1) and.3.8 ml of Solvent (Solv-2). The resulting solution was emulsified and dispersed in 135 ml of a 10% aqueous gelatin solution containing 8 ml of 10% sodium dodecylbenzenesulfonate. Separately, 102.5 g of an emulsion mixture of Silver Halide Emulsion (A) and Silver Halide Emulsion (B) in a weight ratio of 3:7 was mixed and dissolved in 130 g of a 10% aqueous gelatin solution. To the resulting solution were added 26.7 ml of a 0.1% methanol solution of the following blue-sensitive sensitizing dye and 6.9 ml of a 2% aqueous solution of 4-hydroxy-6-methyl-1,3,3a,7-tetrazaindene. Subsequently, the above emulsified dispersion was added thereto. The pH and viscosity of the mixture were adjusted to prepare a coating solution for the First Layer. The viscosity was adjusted by using poly(potassium styrenesulfonate).

Coating solutions for the Second to Seventh Layers were prepared in the same way as in the preparation of the coating solution for the First Layer.

The sodium salt of 1-oxy-3,5-dichloro-S-triazine was used as the hardening agent for gelatin in each layer.

The following spectral sensitizing dyes for the following layers were used.

Blue-sensitive Emulsion Layer;

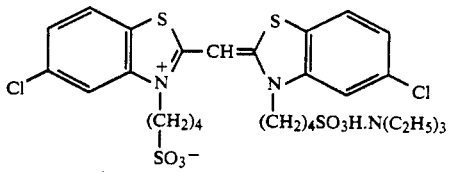

($3.8 \times 10^{-4}$ mol per mol of silver halide of emulsion)

Green-sensitive Emulsion Layer;

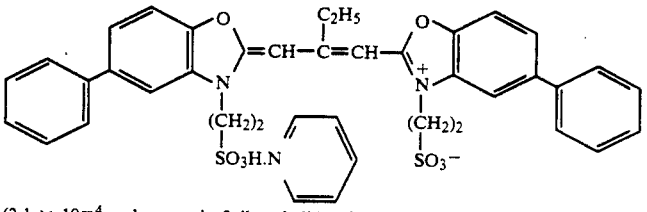

($2.1 \times 10^{-4}$ mol per mol of silver halide of emulsion)

and

-continued

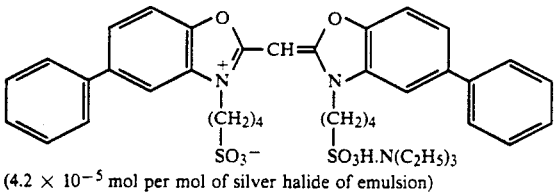

(4.2 × $10^{-5}$ mol per mol of silver halide of emulsion)

Red-sensitive Emulsion Layer;

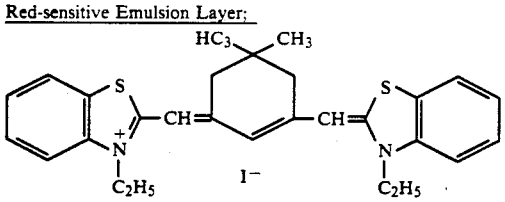

Comparative sensitizing dye for the red sensitive layer.
(6.1 × $10^{-5}$ mol per mol of silver halide of emulsion)

2.3×$10^{-3}$ mol of the following compound per mol of silver halide was added to the red-sensitive emulsion layer as a supersensitizer represented by formula (II).

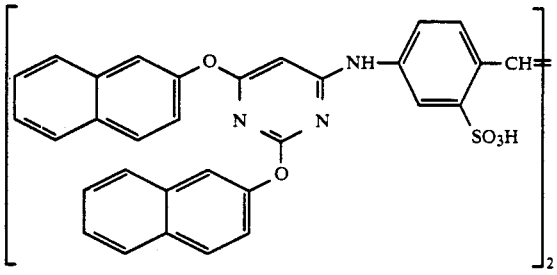

1.2×$10^{-2}$ mol and 1.3×$10^{-3}$ mol of 4-hydroxy-6-methyl-1,3,3a,7-tetrazaindene per mol of silver halide were added to the blue-sensitive emulsion layer and the green-sensitive emulsion layer, respectively. 5.0×$10^{-4}$ mol of 1-(5-methylureidophenyl)-5-mercaptotetrazole per mol of silver halide was added to green-sensitive emulsion layer.

3.5×$10^{-4}$ mol of 2-amino-5-mercapto-1,3,4-thiadiazole per mol of silver halide and 1.7×10-4 mol of 2-mercapto-5-capryloylamidobenzimidazole per mol of silver were added to the red-sensitive emulsion layer.

The following dyes were used as irradiation-preventing dyes.

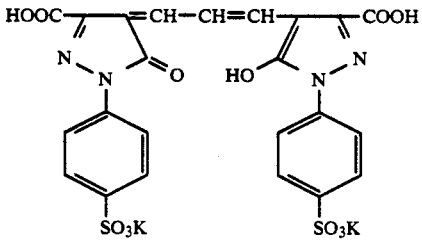

and

-continued

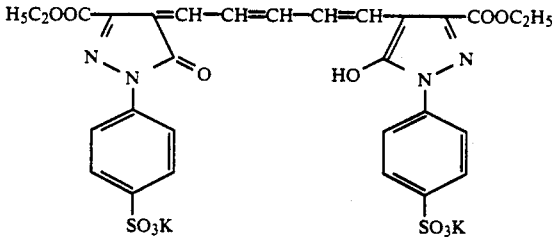

Each layer had the following compositions.

The amounts shown are coating weight (g/$m^2$) and the amounts of silver halide in the emulsions are shown in terms of silver.

LAYER STRUCTURE

Support

A paper support of which both sides were laminated with polyethylene [the polyethylene on the side of the first layer contained white pigment ($TiO_2$) and bluing dye (ultramarine)]

| | |
|---|---|
| First Layer (blue-sensitive layer) | |
| Silver Halide Emulsion (A) | 0.09 |
| Silver Halide Emulsion (B) | 0.21 |
| Gelatin | 1.28 |
| Yellow Coupler (ExY) | 0.68 |
| Anti-Fogging Agent (Cpd-1) | 0.006 |
| Dye Image Stabilizer (Cpd-2) | 0.07 |
| Solvent (Solv-1) | 0.12 |
| Solvent (Solv-2) | 0.12 |
| Second Layer (color mixing inhibiting layer) | |
| Gelatin | 1.34 |
| Color Mixing Inhibitor (Cpd-3) | 0.04 |
| Solvent (Solv-3) | 0.10 |
| Solvent (Solv-4) | 0.10 |
| Third Layer (green-sensitive layer) | |
| Silver Halide Emulsion (C) | 0.075 |
| Silver Halide Emulsion (D) | 0.05 |
| Gelatin | 1.47 |
| Magenta Coupler (ExM-1) | 0.32 |
| Dye Image Stabilizer (Cpd-4) | 0.10 |
| Dye Image Stabilizer (Cpd-5) | 0.08 |
| Dye Image Stabilizer (Cpd-6) | 0.03 |
| Dye Image Stabilizer (Cpd-7) | 0.004 |
| Solvent (Solv-3) | 0.25 |
| Solvent (Solv-5) | 0.40 |
| Fourth Layer (ultraviolet light absorbing layer) | |
| Gelatin | 1.43 |
| Ultraviolet Light Absorber (UV-1) | 0.47 |

-continued

| | |
|---|---|
| Color Mixing Inhibitor (Cpd-3) | 0.05 |
| Solvent (Solv-6) | 0.24 |
| Fifth Layer (red-sensitive layer) | |
| Silver Halide Emulsion (E) | 0.06 |
| Silver Halide Emulsion (F) | 0.14 |
| Gelatin | 0.85 |
| Cyan Coupler (ExC-1) | 0.13 |
| Cyan Coupler (ExC-2) | 0.15 |
| Dye Image Stabilizer (Cpd-2) | 0.25 |
| Anti-Fogging Agent (Cpd-1) | 0.008 |
| Dye Image Stabilizer (Cpd-5) | 0.004 |
| Dye Image Stabilizer (Cpd-6) | 0.007 |
| Dye Image Stabilizer (Cpd-8) | 0.067 |
| Solvent (Solv-1) | 0.16 |
| Sixth Layer (ultraviolet light absorbing layer) | |
| Gelatin | 0.38 |
| Ultraviolet Light Absorber (UV-1) | 0.13 |
| Solvent (Solv-6) | 0.06 |
| Seventh layer (protective layer) | |
| Gelatin | 1.25 |
| Acrylic-Modified Copolymer of Polyvinyl Alcohol (degree of modification: 17%) | 0.05 |
| Liquid Paraffin | 0.02 |

(ExY-1) Yellow Coupler

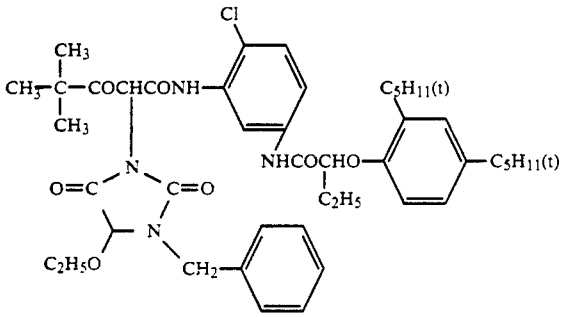

(ExM-1) Magenta Coupler

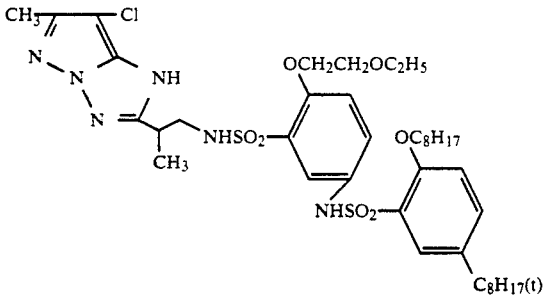

(ExC-1) Cyan Coupler

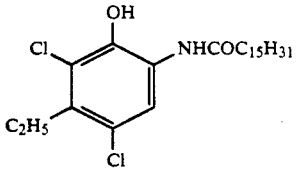

(ExC-2) Cyan Coupler

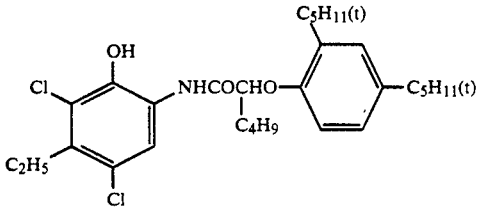

-continued (Cpd-1) Anti-Fogging Agent

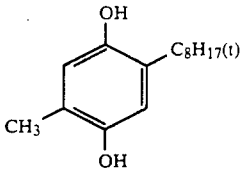

(Cpd-2) Dye Image Stabilizer

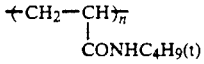

Average Mw: 60,000

(Cpd-3) Color Mixing Inhibitor

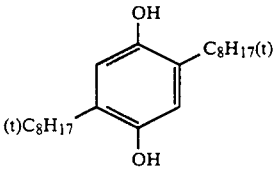

(Cpd-4) Dye Image Stabilizer

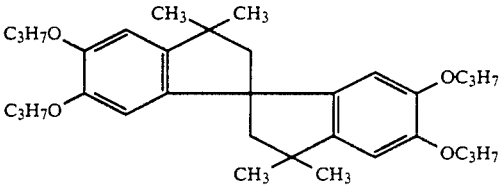

(Cpd-5) Dye Image Stabilizer

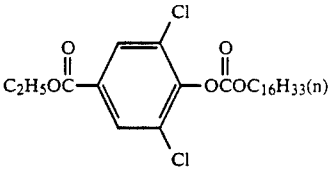

(Cpd-6) Dye Image Stabilizer

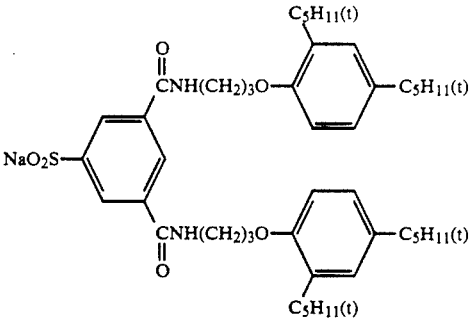

(Cpd-7) Dye Image Stabilizer

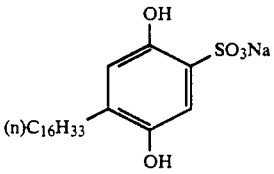

(Cpd-8) Dye Image Stabilizer

-continued

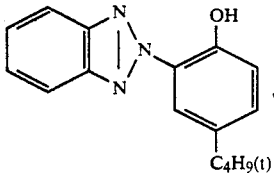

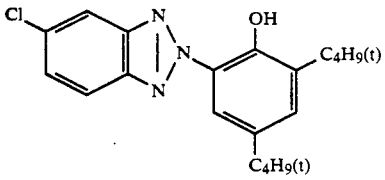

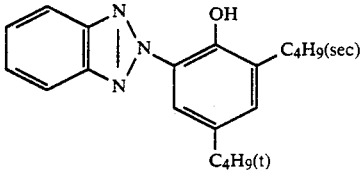

4:2:5 (by weight) mixture (UV-1) Ultraviolet Absorber

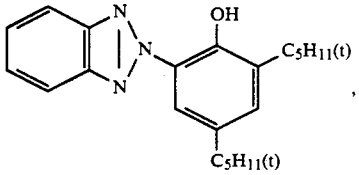

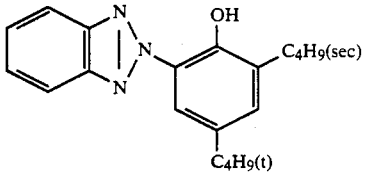

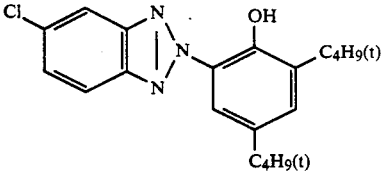

12:10:3 (by weight) mixture (Solv-1) Solvent

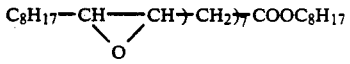

(Solv-2) Solvent $O{=}P{+}O{-}C_9H_{19}\text{-iso})_3$ (Solv-3) Solvent

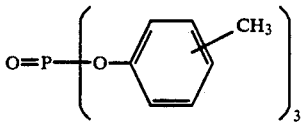

(Solv-4) Solvent

-continued

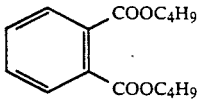

(Solv-5) Solvent

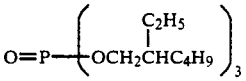

(Solv-6) Solvent

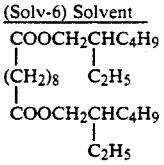

Samples (102) to (111) were prepared in the same manner as in the preparation of the multi-layer color photographic material (Sample 101) except that the red-sensitive sensitizing dyes in the Fifth Layer (red-sensitive layer) and the amounts of hydrophilic colloid in the layer were changed to those given in Table 1 below.

Comparative Sensitizing Dye

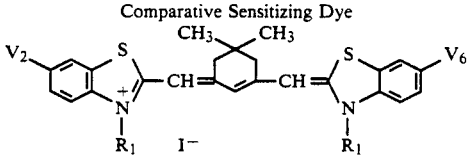

| Compound No. | $R_1$ | $R_2$ | $V_2$ | $V_2$ |
|---|---|---|---|---|
| S-1 | $CH_3$ | $CH_3$ | $CH_3$ | $CH_3$ |
| S-2 | $(CH_2)_2CH_3$ | $C_2H_5$ | $CH_3$ | $CH_3$ |
| S-3 | $(CH_2)_8CH_3$ | $C_2H_5$ | $CH_3$ | $CH_3$ |
| S-3 | $(CH_2)_2$— | $C_2H_5$ | $CH_3$ | $CH_3$ |

TABLE 1

| Sample No. | Red-Sensitive Sensitizing Dye | Hydrophilic Colloid | Amount ($g/m^2$) |
|---|---|---|---|
| (102) | S-1 | gelatin | 0.85 |
| (103) | S-2 | gelatin | 0.85 |
| (104) | S-3 | gelatin | 0.85 |
| (105) | S-4 | gelatin | 0.85 |
| (106) | No. 6 | gelatin | 0.85 |
| (107) | No. 6 | gelatin | 1.36 |
| (108) | No. 6 | gelatin | 1.90 |
| (109) | No. 4 | gelatin | 0.85 |
| (110) | No. 5 | gelatin | 0.85 |
| (111) | No. 10 | gelatin | 0.85 |

The thus-prepared Samples 101 to 111 were tested and the changes in sensitivity and gradation after long-term storage and pressure resistance was evaluated.

The changes in sensitivity and gradation after long-term storage were evaluated by the rate change in sensitivity when sensitivity was measured on the fifth day after coating and after one month under conditions of 35° C. and 60% RH. The change in sensitivity was represented by the change rate ($\Delta S_{0.5}$) of the reciprocal of the exposure amount required to give a density of (fog+0.5). The change in gradation was evaluation from the relation between $\Delta S_{0.5}$ and $\Delta S_{1.5}$ after the change rate ($\Delta S_{1.5}$) of the reciprocal of the exposure amount required to give a density of (fog+1.5) was determined.

Pressure resistance was evaluated in the following manner. A ball point needle having a spherical diameter of 0.1 mm was placed vertically on the surface of the sample, a load of 40 g was moved over the surface of the sample in parallel therewith t a rate of 1 cm/sec. and the sample was then exposed through appropriate filters and an optical wedge, processed and then visually evaluated.

The samples were subjected to gradation exposure for sensitometer through three color separation filters using a sensitometer (FWH type, manufactured by Fuji Photo film Co., Ltd.; color temperature of light source: 3200° K.).

The exposure time was 0.1 second and the exposure was conducted so as to give an exposure amount of 250 CMS. After exposure, the samples were processed in the following processing stages.

| Processing A | | |
|---|---|---|
| Processing Stage | Temperature (°C.) | Time |
| Color Development | 33 | 3 min. 30 sec. |
| Bleaching-Fixing | 33 | 1 min. 30 sec. |
| Rinsing ① | 30 to 34 | 60 sec. |
| Rinsing ② | 30 to 34 | 60 sec. |
| Rinsing ③ | 30 to 34 | 60 sec. |
| Drying | 70 to 80 | 50 sec. |

A three tank countercurrent system of rinsing ③→① was used.

| Color Developing Solution | |
|---|---|
| Water | 800 ml |
| Diethylenetriaminepentaacetic Acid | 1.0 g |
| Nitrilotriacetic Acid | 1.5 g |
| Benzyl Alcohol | 15 ml |
| Diethylene Glycol | 10 ml |
| Sodium Sulfite | 2.0 g |
| Potassium Bromide | 0.5 g |
| Potassium Carbonate | 30 g |
| N-Ethyl-N-(β-methanesulfonamidoethyl)-3-methyl-4-aminoaniline Sulfate | 5.0 g |
| Hydroxylamine Sulfate | 4.0 g |
| Fluorescent Brightener (WHITEX 4B, a product of Sumitomo Chemical Co., Ltd.) | 1.0 g |
| Add water to make | 1000 ml |
| pH (25° C.) | 10.20 |
| Bleaching-fixing solution | |
| Water | 400 ml |
| Ammonium Thiosulfate (700 g/l) | 150 ml |
| Sodium Sulfite | 18 g |
| Ethylenediaminetetraacetic Acid Iron(III) Ammonium | 55 g |
| Disodium Ethylenediaminetetraacetate | 5 g |
| Add water to make | 1000 ml |
| pH (25° C.) | 6.7 |

| Processing B | | |
|---|---|---|
| Processing Stage | Temperature (°C.) | Time |
| Color Development | 37 | 3 min. 30 sec. |
| Bleaching-Fixing | 33 | 1 min. 30 sec. |
| Rinsing ① | 30 to 34 | 60 sec. |
| Rinsing ② | 30 to 34 | 60 sec. |
| Rinsing ③ | 30 to 34 | 60 sec. |
| Drying | 70 to 80 | 60 sec. |

A three tank countercurrent system of rinsing ③→① was used.

Each processing solution had the following composition.

| Color Developing Solution | |
|---|---|
| Water | 800 ml |
| Diethylenetriaminepentaacetic Acid | 1.0 g |
| Nitrilotriacetic Acid | 2.0 g |
| Benzyl Alcohol | 15 ml |
| Diethylene Glycol | 10 ml |
| Sodium Sulfite | 2.0 g |
| Potassium Bromide | 1.0 g |
| Potassium Carbonate | 30 g |
| N-Ethyl-N-(β-methanesulfonamidoethyl)-3-methyl-4-aminoaniline Sulfate | 4.5 g |
| Hydroxylamine Sulfate | 3.0 g |
| Fluorescent Brightener (WHITEX 4B, a product of Sumitomo Chemical Co., Ltd.) | 1.0 g |
| Add water to make | 1000 ml |
| pH (25° C.) | 10.25 |
| Bleaching-Fixing Solution | |
| Water | 400 ml |
| Ammonium Thiosulfate (700 g/l) | 150 ml |
| Sodium Sulfite | 18 g |
| Ethylenediaminetetraacetic Acid Iron(III) Ammonium | 55 g |
| Disodium Ethylenediaminetetraacetate | 5 g |
| Add water to make | 1000 ml |
| pH (25° C.) | 6.70 |

| Processing C | | |
|---|---|---|
| Processing Stage | Temperature (°C.) | Time |
| Color Development | 38 | 1 min. 40 sec. |
| Bleaching-Fixing | 35 | 60 sec |
| Rinse ① | 33 to 35 | 20 sec. |
| Rinse ② | 33 to 35 | 20 sec. |
| Rinse ③ | 33 to 35 | 20 sec. |
| Drying | 70 to 80 | 50 sec. |

Each processing solution had the following composition:

| Color Developing Solution | |
|---|---|
| Water | 800 ml |
| Diethylenetriaminepentaacetic Acid | 1.0 g |
| Nitrilotriacetic Acid | 2.0 g |
| 1-Hydroxyethylidene-1,1-diphosphonic Acid | 2.0 g |
| Benzyl Alcohol | 16 ml |
| Diethylene Glycol | 10 ml |
| Sodium Sulfite | 2.0 g |
| Potassium Bromide | 0.5 g |
| Potassium Carbonate | 30 g |
| N-Ethyl-N-(β-methanesulfonamidoethyl)-3-methyl-4-aminoaniline Sulfate | 5.5 g |
| Hydroxylamine Sulfate | 2.0 g |
| Fluorescent Brightener (WHITEX 4B, a product of Sumitomo Chemical Co., Ltd.) | 1.5 g |
| Add water to make | 1000 ml |
| pH (25° C.) | 10.20 |
| Bleaching-fixing solution | |
| Water | 400 ml |
| Ammonium Thiosulfate (700 g/l) | 80 ml |
| Sodium Sulfite | 24 g |
| Ethylenediaminetetraacetic Acid Iron(III) Ammonium | 30 g |
| Disodium Ethylenediaminetetraacetate | 5 g |
| Add water to make | 1000 ml |
| pH (25° C.) | 6.50 |

Rinsing Solution

Ion-exchanged water (the concentration of each of calcium and magnesium was not higher than 3 ppm).

The samples for the evaluation of pressure resistance were exposed through a red filter and an optical wedge in the same manner as that described above and processed in the above-described processing stages.

The results obtained with the above Processing A are shown in Table 2 below.

TABLE 2

| Sample No. | Red-Sensitive Layer Vo (ml/m²) | Vg (ml/m²) | (Vo/Vg) | Change in Sensitivity $\Delta S_{0.5}$ | $\Delta S_{1.5}$ | Pressure Resistance |
|---|---|---|---|---|---|---|
| 101 | 0.71 | 0.63 | 1.12 | −0.05 | −0.03 | Δ |
| 102 | 0.71 | 0.63 | 1.12 | −0.06 | −0.04 | Δ |
| 103 | 0.71 | 0.63 | 1.12 | −0.06 | −0.03 | Δ |
| 104 | 0.71 | 0.63 | 1.12 | −0.04 | −0.03 | Δ |
| 105 | 0.71 | 0.63 | 1.12 | −0.05 | −0.03 | Δ |
| 106 | 0.71 | 0.63 | 1.12 | −0.01 | −0.01 | ○ |
| 107 | 0.71 | 1.01 | 0.70 | −0.02 | −0.02 | Δ |
| 108 | 0.71 | 1.43 | 0.50 | −0.03 | −0.03 | x |
| 109 | 0.71 | 0.63 | 1.12 | −0.01 | −0.01 | ○ |
| 110 | 0.71 | 0.63 | 1.12 | −0.01 | −0.01 | ○ |
| 111 | 0.71 | 0.63 | 1.12 | −0.00 | −0.00 | ○ |

The change in sensitivity was evaluated from the value of $\Delta S_{0.5}$ and the change in gradation was evaluated from the relation between $\Delta S_{0.5}$ and $\Delta S_{1.5}$.

Pressure resistance was visually evaluated and the evaluation was made in three grades wherein the symbol ○ indicates that no increase or decrease in sensitivity was observed; the symbol Δ indicates that a change in sensitivity was slightly observed; and the symbol X indicates that the sensitivity was greatly changed.

It is apparent from the results in Table 2 above that since comparative Samples 101 to 105 contain the red-sensitive sensitizing dyes which are outside the scope of the present invention, the sensitivity and gradation are greatly changed during long-term storage and pressure resistance is low. Although comparative Samples 107 and 108 contained the red-sensitive sensitizing dye of the present invention, the $(V_o/V_g)$ ratio is outside the scope of the present invention so that the effect of improving the change in sensitivity during long-term storage is insufficient and pressure resistance is low. On the other hand, Samples 106 and 109 to 111 of the present invention scarcely resulted in a change in sensitivity and gradation during long-term storage and have greatly improved pressure resistance.

The same results were obtained using Processing B and Processing C.

EXAMPLE 2

The procedure of Example 1 was repeated except that the blue-sensitive layer and the green-sensitive layer of Sample 106 were changed to those shown in Table 3 below to obtain Samples 201 to 209.

TABLE 3

| Sample No. | Blue-Sensitive Layer Gelatin (g/m²) | Green-Sensitive Layer Magenta Coupler | Gelatin (g/m²) |
|---|---|---|---|
| 201 | 2.00 | Same as Sample 106 | 1.47 |
| 202 | 1.65 | Same as Sample 106 | 1.47 |
| 203 | 0.75 | Same as Sample 106 | 1.47 |
| 204 | 1.28 | Same as Sample 106 | 2.20 |
| 205 | 1.28 | Same as Sample 106 | 1.85 |
| 206 | 1.28 | Same as Sample 106 | 0.92 |
| 207 | 1.28 | Same as Sample 106 | 1.47 |
| 208 | 1.28 | M-12 (0.26) | 1.47 |
| 209 | 1.28 | M-17 (0.34) | 1.47 |

In Samples 208 and 209, the numerals in parentheses after the magenta couplers represent the coating weight (g/m²).

The thus-prepared Samples 201 to 209 were tested in the same manner as in Example 1, and the change in sensitivity during long-term storage and pressure resistance were evaluated.

In the evaluation of pressure resistance, the samples were exposed in such a manner that a red filter and an optical wedge were used for the red-sensitive layer, a green filter and an optical wedge were used for the green-sensitive layer, and a blue filter and an optical wedge were used for the blue-sensitive layer. Processing was made by the processing B. The results are shown in Table 4 below.

TABLE 4

| Sample No. | (Vo/Vg) R | G | B | Change in Sensitivity of Red-Sensitivity Layer $\Delta S_{0.5}$ | $\Delta S_{1.5}$ | Pressure Resistance RGB |
|---|---|---|---|---|---|---|
| 201 | 1.12 | 1.11 | 0.61 | −0.01 | −0.01 | ○○x |
| 202 | 1.12 | 1.11 | 0.75 | −0.01 | −0.01 | ○○x |
| 203 | 1.12 | 1.11 | 1.64 | −0.01 | −0.01 | *○○○ |
| 204 | 1.12 | 0.68 | 0.96 | −0.01 | −0.01 | ○x○ |
| 205 | 1.12 | 0.80 | 0.96 | −0.01 | −0.01 | ○Δ○ |
| 206 | 1.12 | 1.62 | 0.96 | −0.01 | −0.01 | *○○○ |
| 207 | 1.12 | 1.11 | 0.96 | −0.01 | −0.01 | ○○○ |
| 208 | 1.12 | 0.96 | 0.96 | −0.01 | −0.01 | ○○○ |
| 209 | 1.12 | 1.03 | 0.96 | −0.01 | −0.01 | ○○○ |

R, G and B in Table 4 represent the red-sensitive layer, the green-sensitive layer and the blue-sensitive layer, respectively. The evaluation of pressure resistance was made in the same manner as in Example 1. In the green-sensitive and blue-sensitive layers, a decrease in sensitivity was observed.

It is apparent from the results in Table 4 that, in the Comparative Samples 201, 202, 204 and 205, any one of the pressure resistance was poor in each of the layers. In the Samples 203 and 206 having a $(V_o/V_g)$ ratio of greater than 1.6 the pressure resistance is marked by the symbol * which means that layers peeling and exudation of oil were observed and undesirable physical properties of layers existed.

Samples 207 to 209 show that a change in sensitivity during long-term storage is scarcely occurs and pressure resistance is good.

EXAMPLE 3

Silver halide Emulsions G to I were prepared in the same manner as in Example 1.

The shapes, mean grain sizes, halogen compositions and coefficients of variation of these Emulsions G to I are shown in the following Table. The remainder of the halogen composition is silver bromide which is localized on part of the grains.

| Emulsion | Shape | Mean Grain Size (μm) | Halogen Composition (Cl mol %) | Coefficient of Variation |
|---|---|---|---|---|
| (G) | cube | 0.90 | 99.4 | 0.08 |
| (H) | cube | 0.42 | 98.8 | 0.07 |
| (I) | cube | 0.37 | 98.3 | 0.08 |

A combination (Sens-1) of blue-sensitive sensitizing dyes was used for the silver halide emulsion (G) of the blue-sensitive silver halide emulsion layer. A combination (Sens-2) of green-sensitive sensitizing dyes was used for the silver halide emulsion (H) of the green-sensitive silver halide emulsion layer. Red-sensitive sensitizing dye (Sens-3) was used for the silver halide emulsion (I) of the red-sensitive silver halide emulsion layer.

(Sens-1)

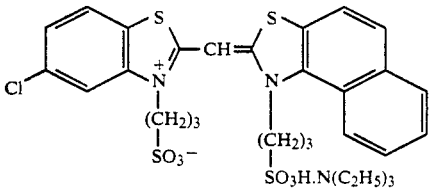

($1.6 \times 10^{-4}$ mol per mol of silver halide in emulsion)

and

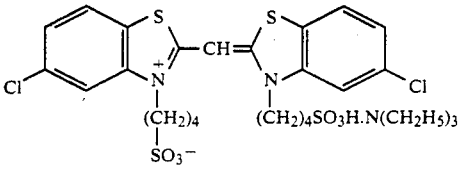

($1.7 \times 10^{-4}$ mol per mol of silver halide in emulsion)

(Sens-2)

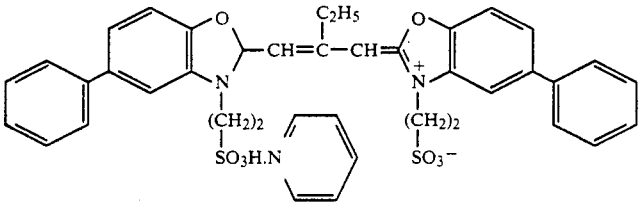

($4.0 \times 10^{-4}$ mol per mol of silver halide in emulsion)

and

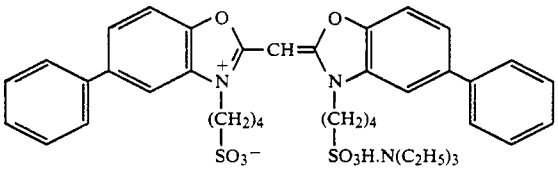

($7.8 \times 10^{-5}$ mol per mol of silver halide in emulsion)

(Sens-3)

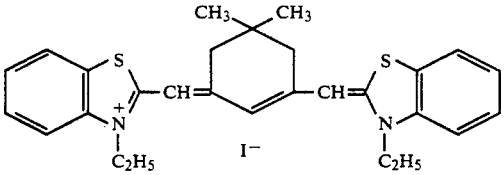

($7.8 \times 10^{-5}$ mol per mol of silver halide in emulsion)

A paper support (both sides thereof being laminated with polyethylene) was coated with the following layers to prepare a multi-layer color photographic material Sample 301 having the following layer structure. Coating solutions were prepared in the same dichloro-s-triazine was used as the hardening agent in each layer.

$6.9 \times 10^{-4}$ mol of the following compound per mol of silver halide was added to the red-sensitive emulsion layer.

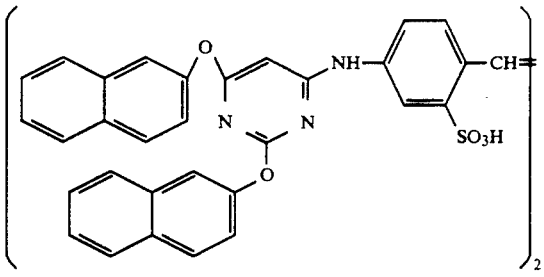

The following dyes were used as irradiation-preventing dyes.

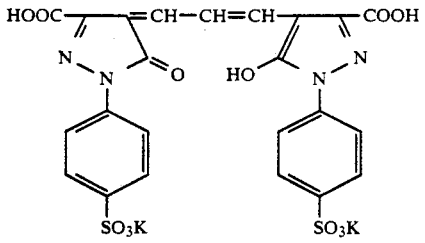

and

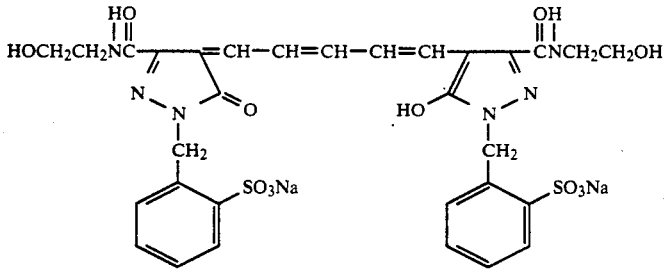

Each layer had the following composition. The numbers shown are coating weight (g/m$^2$). The amounts of silver halide emulsions are represented by the coating weight in terms of silver.

LAYER STRUCTURE

Support

A paper support of which both sides being laminated with polyethylene [the polyethylene on the side of the first layer contained a white pigment ($TiO_2$) and a bluing dye (ultramarine)].

| | |
|---|---|
| First Layer (blue-sensitive layer) | |
| Silver Halide Emulsion (G) | 0.26 |
| Gelatin | 1.13 |
| Yellow Coupler (ExY) | 0.66 |
| Dye Image Stabilizer (Cpd-2) | 0.01 |
| Solvent (Solv-4) | 0.28 |
| Second Layer (color mixing inhibiting layer) | |
| Gelatin | 0.89 |
| Color Mixing Inhibitor (Cpd-3) | 0.08 |
| Solvent (Solv-3) | 0.20 |
| Solvent (Solv-4) | 0.20 |
| Third Layer (green-sensitive layer) | |
| Silver Halide Emulsion (H) | 0.30 |
| Gelatin | 1.04 |
| Magenta Coupler (ExM-2) | 0.26 |
| Dye Image Stabilizer (Cpd-4) | 0.10 |
| Dye Image Stabilizer (Cpd-9) | 0.05 |
| Dye Image Stabilizer (Cpd-10) | 0.01 |
| Dye Image Stabilizer (Cpd-11) | 0.08 |
| Solvent (Solv-3) | 0.20 |
| Solvent (Solv-5) | 0.16 |
| Fourth Layer (ultraviolet light absorbing layer) | |
| Gelatin | 1.42 |
| Ultraviolet Light Absorber (UV-1) | 0.47 |
| Color Mixing Inhibitor (Cpd-3) | 0.05 |
| Solvent (Solv-6) | 0.24 |
| Fifth Layer (red-sensitive layer) | |
| Silver Halide Emulsion (I) | 0.21 |
| Gelatin | 0.85 |
| Cyan Coupler (ExC-3) | 0.18 |
| Cyan Coupler (ExC-4) | 0.08 |
| Cyan Coupler (ExC-5) | 0.02 |
| Cyan Coupler (ExC-1) | 0.02 |
| Dye Image Stabilizer (Cpd-2) | 0.27 |
| Dye Image Stabilizer (Cpd-12) | 0.04 |
| Dye Image Stabilizer (Cpd-8) | 0.17 |

-continued

| | |
|---|---|
| Solvent (Solv-7) | 0.30 |
| Sixth Layer (ultraviolet light absorbing layer) | |
| Gelatin | 0.48 |
| Ultraviolet Light Absorber (UV-1) | 0.16 |
| Solvent (Solv-6) | 0.08 |
| Seventh Layer (protective layer) | |
| Gelatin | 1.22 |
| Acrylic-Modified Copolymer of Polyvinyl Alcohol (a degree of modification: 17%) | 0.05 |
| Liquid Paraffin | 0.02 |

Compound used in the above-described layers except compounds which were shown hereinbefore are shown below.

(ExM-2) Magenta Coupler

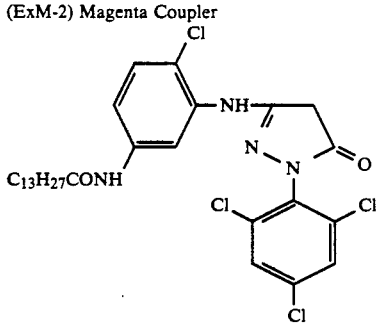

(ExC-3) Cyan Coupler

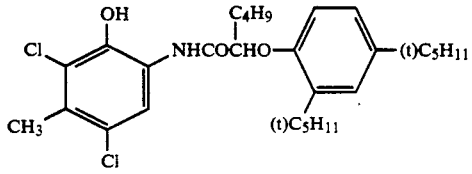

(ExC-4) Cyan Coupler

-continued

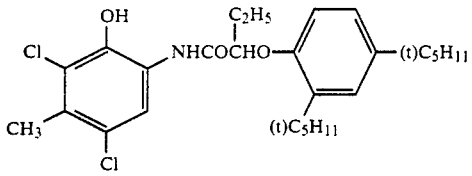

(ExC-5) Cyan Coupler

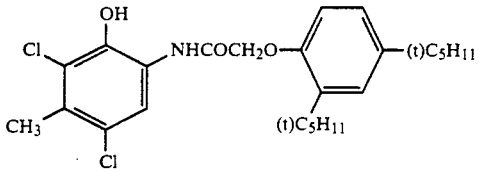

(Cpd-9) Dye Image Stabilizer

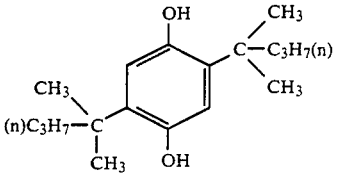

(Cpd-10) Dye Image Stabilizer

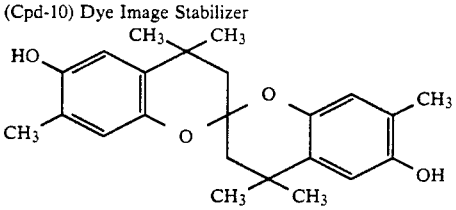

(Cpd-11) Dye Image Stabilizer

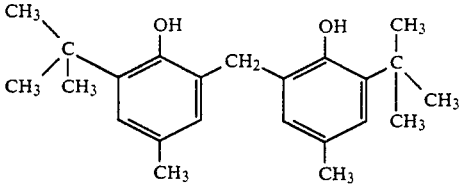

(Cpd-12) Dye Image Stabilizer

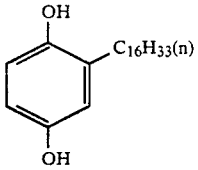

(Solv-7) Solvent

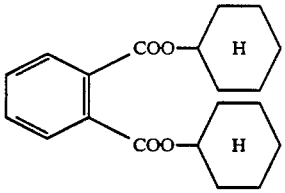

Samples 302 to 311 were prepared in the same manner as in the preparation of the multi-layer color photographic material, Sample 301 except that the red-sensitive sensitizing dyes in the Fifth Layer (red-sensitive layer) and the amount of hydrophilic colloid in the layer were changed to those shown in Table 5 below.

The same comparative sensitizing dyes as those used in Example 1 were used.

TABLE 5

| Sample No. | Red-Sensitive Sensitizing Dye | Hydrophilic Colloid | Amount ($g/m^2$) |
|---|---|---|---|
| 302 | S-1 | gelatin | 0.85 |
| 303 | S-2 | gelatin | 0.85 |
| 304 | S-3 | gelatin | 0.85 |
| 305 | S-4 | gelatin | 0.85 |
| 306 | No. 6 | gelatin | 0.85 |
| 307 | No. 6 | gelatin | 1.35 |
| 308 | No. 6 | gelatin | 2.00 |
| 309 | No. 4 | gelatin | 0.85 |
| 310 | No. 5 | gelatin | 0.85 |
| 311 | No. 10 | gelatin | 0.85 |

The thus-prepared Samples 301 to 311 were tested and the change in sensitivity and gradation during long-term storage and pressure resistance were evaluated in the same manner as in Example 1.

The processing was carried out in the following stages.

Processing D

| Processing Stage | Temperature (°C.) | Time |
|---|---|---|
| Color Development | 38 | 45 sec. |
| Bleaching-Fixing | 30 to 36 | 45 sec. |
| Rinse ① | 30 to 37 | 30 sec. |
| Rinse ② | 30 to 37 | 30 sec. |
| Rinse ③ | 30 to 37 | 30 sec. |
| Drying | 70 to 80 | 60 sec. |

Each processing solution had the following composition.

| | |
|---|---|
| Color Developing Solution | |
| Water | 800 ml |
| Ethylenediamine-N,N,N,N-tetramethylene-phosphonic Acid | 3.0 g |
| N,N-Di(carboxymethyl)hydrazine | 4.5 g |
| Sodium Chloride | 3.5 g |
| Potassium Bromide | 0.025 g |
| Potassium Carbonate | 25.0 g |
| N-Ethyl-N-(β-methanesulfonamidoethyl-3-methyl-4-aminoaniline Sulfate | 5.0 g |
| Fluorescent Brightener (WHITEX 4B, a product of Sumitomo Chemical Co., Ltd.) | 1.2 g |
| Add water to make | 1000 ml |
| pH (25° C.) | 10.05 |
| Bleaching-Fixing Solution | |
| Water | 400 ml |
| Ammonium Thiosulfate (55% aqueous solution) | 100 ml |
| Sodium Sulfite | 17 g |
| Ethylenediaminetetraacetic Acid iron(III) Ammonium | 55 g |
| Disodium Ethylenediaminetetraacetate | 5 g |
| Ammonium bromide | 40 g |
| Glacial Acetic Acid | 9 g |
| Add Water to make | 1000 ml |
| pH (25° C.) | 5.80 |

Rinsing Solution

Ion-exchanged water (the concentration of each of calcium and magnesium was not higher than 3 ppm).

The results obtained are shown in Table 6 below.

TABLE 6

| Sample No. | (Vo/Vg) R | G | B | Change in Sensitivity $\Delta S_{0.5}$ | $\Delta S_{1.5}$ | Pressure Resistance |
|---|---|---|---|---|---|---|
| 301 | 1.48 | 1.00 | 1.01 | −0.06 | −0.07 | Δ |
| 302 | 1.48 | 1.00 | 1.01 | −0.06 | −0.05 | Δ |
| 303 | 1.48 | 1.00 | 1.01 | −0.07 | −0.05 | Δ |
| 304 | 1.48 | 1.00 | 1.01 | −0.05 | −0.05 | Δ |
| 305 | 1.48 | 1.00 | 1.01 | −0.06 | −0.05 | Δ |
| 306 | 1.48 | 1.00 | 1.01 | −0.01 | −0.01 | ○ |
| 307 | 0.93 | 1.00 | 1.01 | −0.01 | −0.01 | ○ |
| 308 | 0.63 | 1.00 | 1.01 | −0.03 | −0.03 | x |
| 309 | 1.48 | 1.00 | 1.01 | −0.01 | −0.01 | ○ |
| 310 | 1.48 | 1.00 | 1.01 | −0.01 | −0.01 | ○ |
| 311 | 1.48 | 1.00 | 1.01 | −0.00 | −0.00 | ○ |

With regard to pressure resistance, the green-sensitive layer and blue-sensitive layer did not cause any difficulty. Thus, the evaluation result is not indicated. The evaluation of the red-sensitive layer was made in three grades in the same manner as in Example 1, wherein the symbol Δ indicates that an increase in sensitivity was slightly observed and the symbol x indicates that sensitivity was greatly changed while the symbol ○ shows substantially no change.

It is apparent from the results in Table 6 that a great change in sensitivity and gradation during long-term storage of Samples 301 to 305 occurred and these samples have poor pressure resistance. Although the comparative sample 308 contained the red-sensitive sensitizing dye of the present invention, the ($V_o/V_g$) ratio is outside the scope of the present invention. Hence the effect of improving the change in sensitivity during long-term storage was insufficient and pressure resistance was poor.

On the other hand, Samples 306, 307 and 309 to 311 according to the present invention scarcely showed any change in sensitivity and gradation during long-term storage and they have sufficiently improved, pressure resistance.

EXAMPLE 4

A paper support (both sides thereof being laminated with polyethylene) was coated with the following layers to prepare a multi-layer color photographic material Sample 401 having the following layer structure. Coating solutions were prepared in the same manner as in Example 1. The sodium salt of 1-oxy-3,5-dichloro-s-triazine was used as the hardening agent for the gelatin in each layer.

$6.9\times10^{-5}$ mol of the following compound per mol of silver halide was added to the red-sensitive emulsion layer.

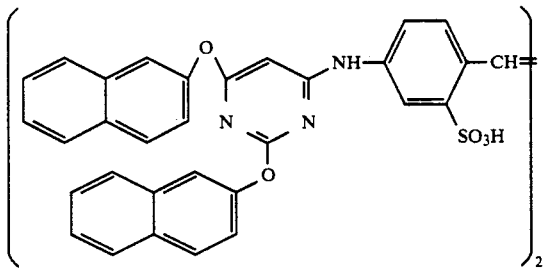

The following dyes were used as irradiation-preventing dyes.

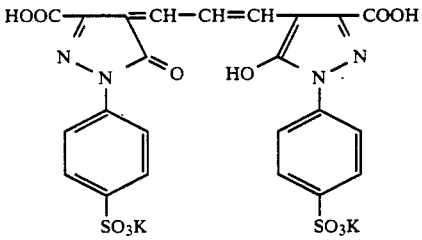

and

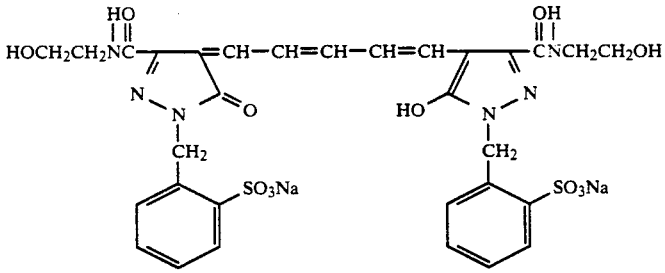

Each layer had the following composition. The numbers represent the coating weight (g/m²). The amounts of silver halide emulsions are represented as coating weight in terms of silver.

Support

A paper support of which both sides being laminated with polyethylene [polyethylene on the side of the first layer contained a white pigment ($TiO_2$) and a bluing dye (ultramarine)].

| | |
|---|---|
| First Layer (blue-sensitive layer) | |
| Silver Halide Emulsion (G) | 0.25 |
| Gelatin | 1.07 |
| Yellow Coupler (ExY) | 0.63 |
| Dye Image Stabilizer (Cpd-2) | 0.01 |
| Solvent (Solv-4) | 0.26 |
| Second Layer (color mixing inhibiting layer) | |
| Gelatin | 1.24 |
| Color Mixing Inhibitor (Cpd-3) | 0.11 |
| Solvent (Solv-3) | 0.28 |

-continued

| | |
|---|---|
| Solvent (Solv-4) | 0.28 |
| Third layer (green-sensitive layer) | |
| Silver Halide Emulsion (H) | 0.12 |
| Gelatin | 1.24 |
| Magenta Coupler (ExM-1) | 0.26 |
| Dye Image Stabilizer (Cpd-4) | 0.08 |
| Dye Image Stabilizer (Cpd-5) | 0.06 |
| Dye Image Stabilizer (Cpd-6) | 0.02 |
| Dye Image Stabilizer (Cpd-7) | 0.003 |
| Solvent (Solv-3) | 0.20 |
| Solvent (Solv-5) | 0.32 |
| Fourth Layer (ultraviolet light absorbing layer) | |
| Gelatin | 1.42 |
| Ultraviolet Light Absorber (UV-1) | 0.47 |
| Color Mixing Inhibitor (Cpd-3) | 0.05 |
| Solvent (Solv-6) | 0.24 |
| Fifth Layer (red-sensitive layer) | |
| Silver Halide Emulsion (I) | 0.20 |
| Gelatin | 1.05 |
| Cyan Coupler (ExC-3) | 0.20 |
| Cyan Coupler (ExC-4) | 0.09 |
| Cyan Coupler (ExC-5) | 0.03 |
| Cyan Coupler (ExC-1) | 0.03 |
| Dye Image Stabilizer (Cpd-2) | 0.31 |
| Dye Image Stabilizer (Cpd-12) | 0.04 |
| Dye Image Stabilizer (Cpd-8) | 0.19 |
| Solvent (Solv-7) | 0.35 |
| Sixth Layer (ultraviolet light absorbing layer) | |
| Gelatin | 0.48 |
| Ultraviolet Light Absorber (UV-1) | 0.16 |
| Solvent (Solv-6) | 0.08 |
| Seventh Layer (protective layer) | |
| Gelatin | 1.22 |
| Acrylic-Modified Copolymer of Polyvinyl Alcohol (degree of modification: 17%) | 0.05 |
| Liquid Paraffin | 0.02 |

Samples 402 to 410 were prepared in the same manner as in the preparation of multi-layer color photographic material Sample 401 except that the magenta couplers in the Third Layer (green-sensitive layer), the red-sensitive sensitizing dyes in the Fifth Layer (red-sensitive layer) and the amount of gelatin in the layers were changed as shown in Table 7 below. The same comparative sensitizing dyes as those in Example 1 were used.

TABLE 7

| Sample No. | Green-Sensitive Layer Magenta Coupler | Red-Sensitive Layer Sensitizing Dye | Gelatin ($g/m^2$) |
|---|---|---|---|
| 402 | Same as Sample 401 | S-1 | 1.05 |
| 403 | Same as Sample 401 | S-3 | 1.05 |
| 404 | Same as Sample 401 | No. 6 | 1.05 |
| 405 | Same as Sample 401 | No. 6 | 1.90 |
| 406 | Same as Sample 401 | No. 4 | 1.05 |
| 407 | Same as Sample 401 | No. 5 | 1.05 |
| 408 | Same as Sample 401 | No. 10 | 1.05 |
| 409 | M-12 (0.26) | No. 6 | 1.05 |
| 410 | M-18 (0.26) | No. 6 | 1.05 |

The thus-prepared Samples 401 to 410 were evaluated in the same manner as in Example 1. Processing was carried out by Processing D.

The results obtained are shown in Table 8 below.

TABLE 8

| Sample | (Vo/Vg) | | | Change in Sensitivity | | Pressure |
|---|---|---|---|---|---|---|
| No. | R | G | B | $\Delta S_{0.5}$ | $\Delta S_{1.5}$ | Resistance |
| 401 | 1.37 | 0.96 | 1.01 | −0.05 | −0.06 | Δ |
| 402 | 1.37 | 0.96 | 1.01 | −0.06 | −0.05 | Δ |
| 403 | 1.37 | 0.96 | 1.01 | −0.05 | −0.04 | Δ |
| 404 | 1.37 | 0.96 | 1.01 | −0.01 | −0.01 | ○ |

TABLE 8-continued

| Sample | (Vo/Vg) | | | Change in Sensitivity | | Pressure |
|---|---|---|---|---|---|---|
| No. | R | G | B | $\Delta S_{0.5}$ | $\Delta S_{1.5}$ | Resistance |
| 405 | 0.76 | 0.96 | 1.01 | −0.03 | −0.03 | Δ |
| 406 | 1.37 | 0.96 | 1.01 | −0.01 | −0.01 | ○ |
| 407 | 1.37 | 0.96 | 1.01 | −0.01 | −0.01 | ○ |
| 408 | 1.37 | 0.96 | 1.01 | −0.02 | −0.01 | ○ |
| 409 | 1.37 | 0.96 | 1.01 | −0.01 | −0.01 | ○ |
| 410 | 1.37 | 0.96 | 1.01 | −0.01 | −0.01 | ○ |

With regard to pressure resistance, the green-sensitive layer and the blue-sensitive layer did not cause any difficulty. Thus, the result of evaluation is not shown. The evaluation of the red-sensitive layer was made in three grades in the same manner as in Example 1, wherein the symbol Δ indicates that an increase in sensitivity was slightly observed and the symbol x indicates that an increase in sensitivity greatly occurred while the symbol ○ shows substantially no change.

It is apparent from the results in Table 8 that the comparative Samples 401 to 403 and 405 and Samples 404 and 406 to 410 of the invention give similar results to those obtained in other Examples, poor in the case of the comparative samples and good in the case of the samples in accordance with the present invention.

According to the present invention, silver halide color photographic materials which have excellent pressure resistance and scarcely undergo a change in sensitivity and gradation during long-term storage can be obtained.

While the present invention has been described in detail and with reference to specific embodiments thereof, it is apparent to one skilled in the art that various changes and modifications can be made therein without departing from the spirit and scope of the present invention.

What is claimed is:

1. A silver halide color photographic light-sensitive material comprising a support having thereon at least one silver halide emulsion layer, wherein at least one silver halide emulsion layer contains a compound represented by the following general formula (I)

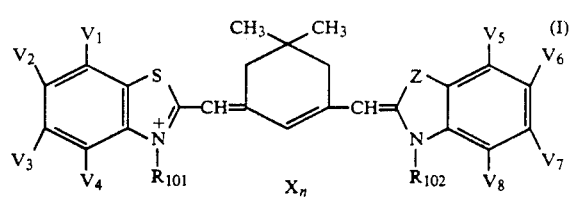

(I)

wherein Z represents an oxygen atom or a sulfur atom; $R_{101}$ and $R_{102}$, which may be the same or different, each represents an alkyl group and at least one of $R_{101}$ and $R_{102}$ is a butyl group, a pentyl group, a hexyl group, a heptyl group or an octyl group; $V_1$, $V_2$, $V_3$, $V_4$, $V_5$, $V_6$, $V_7$ and $V_8$, which may be the same or different, each represents a hydrogen atom, a halogen atom, an alkyl group, an acyl group, an acyloxy group, an alkoxycarbonyl group, a carbamoyl group, a sulfamoyl group, a carboxyl group, a cyano group, an alkoxy group, an alkylthio group, an alkylsulfonyl group, a sulfo group or an aryl group; of $V_1$ to $V_8$, two groups attached to neighboring carbon atoms do not combine together to form a condensed ring, and when each Hammett's σp value is referred to as $\sigma pi(i=1\sim8)$ and $Y=\sigma p1+\sigma p2+\sigma p3+\sigma p4+\sigma p5+\sigma p6+\sigma p7+\sigma p8$, $Y\leqq -0.08$ where Z is an oxygen atom or $Y\leqq -0.15$ where Z is a sulfur atom; X represents a counter ion; and n represents a value required for the neutralization of electric charge; and the ratio ($V_o/V_g$) of the total volume ($V_o$) of oil droplets present in said silver halide emulsion layer to the total volume ($V_g$) of hydrophilic colloid present therein is 0.8 or greater.

2. A silver halide color photographic light-sensitive material as in claim 1, wherein the ratio ($V_o/V_g$) of the total volume ($V_o$) of oil droplets present in said silver halide emulsion layer to the total volume ($V_g$) of hydrophilic colloid present in the same emulsion layer is in the range of 0.8 to 1.6.

3. A silver halide color photographic light-sensitive material as in claim 1, wherein the ratio ($V_o/V_g$) of the total volume ($V_o$) of oil droplets present in each of silver halide emulsion layers to the total volume ($V_g$) of hydrophilic colloid present in each of the silver halide emulsion layers is in the range of 0.9 to 1.6.

4. A silver halide color photographic light-sensitive material as in claim 1, wherein $Y\leqq -0.15$ where Z is an oxygen atom.

5. A silver halide color photographic light-sensitive material as in claim 4, wherein $-0.90\leqq Y\leqq -0.17$ where Z is an oxygen atom.

6. A silver halide color photographic light-sensitive material as in claim 1, wherein $Y\leqq 0.30$ where Z is a sulfur atom.

7. A silver halide color photographic light-sensitive material as in claim 6, wherein $-1.05\leqq Y\leqq -0.34$ where Z is a sulfur atom.

8. A silver halide color photographic light-photographic light-sensitive material as in claim 1, wherein at least one of $R_{101}$ and $R_{102}$ is a pentyl group.

9. A silver halide color photographic light-sensitive material as in claim 1, wherein $V_1$ to $V_8$ are selected from the group consisting of a hydrogen atom, an unsubstituted alkyl group and an alkoxy group, with the proviso that $Y\leqq -0.08$ where Z is an oxygen atom or $Y\leqq -0.15$ where Z is a sulfur atom.

10. A silver halide color photographic light-sensitive material as in claim 1, wherein the photographic material contains at least one of a cyan coupler, a magenta coupler and a yellow coupler.

11. A silver halide color photographic light-sensitive material as in claim 1, wherein the amount of the compound represented by formula (I) is $1\times10^{-6}$ to $1\times10^{-3}$ mol per mol of silver halide.

12. A silver halide color photographic light-sensitive material as in claim 1, wherein said silver halide emulsion layer contains at least one super-sensitizing agent represented by formula (II):

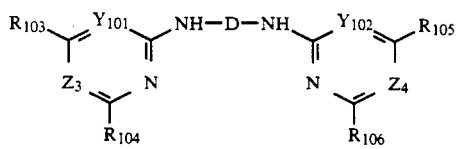

(II)

wherein D is a bivalent aromatic residue; $R_{103}$, $R_{104}$, $R_{105}$ and $R_{106}$, which may be the same or different, are each a hydrogen atom, a hydroxyl group, an alkoxy group, an aryloxy group, a halogen atom, a heterocyclic group, a mercapto group, an alkylthio group, an arylthio group, a heterocyclic thio group, an amino group, an alkylamino group, a cyclohexylamino group, an arylamino group, a heterocyclic amino group, an aralkylamino group, an aryl group, or substituted groups thereof;

$Y_{101}$ and $Z_3$ are each —N= or —CH= and at least one of $Y_{101}$ and $Z_3$ is —N=; and $Y_{102}$ and $Z_4$ have the same meaning as $Y_{101}$ and $Z_3$.

13. A silver halide color photographic light-sensitive material as in claim 12, wherein the amount of said supersensitizing agent is $1\times10^{-6}$ mol to $1\times10^{-1}$ mol per mol of silver halide.

14. A silver halide color photographic light-sensitive material as in claim 12, wherein the molar ratio of the amount of the compound represented by formula (I) to the amount of the supersensitizing agent is 1/50 to 10/1.

15. A silver halide color photographic light-sensitive material as in claim 12, wherein the silver halide in said silver halide emulsion layer is silver chloride or silver chlorobromide containing silver chloride in an amount of at least 90 mol %.

16. A silver halide color photographic light-sensitive material as in claim 1, wherein said silver halide color photographic light sensitive material contains at least one of water-insoluble high-molecular weight compound and a high-boiling point organic solvent having a dielectric constant of 2 to 20 (at 25° C.) and a refractive index of 1.3 to 1.7 (at 25° C.) as a dispersion medium.

* * * * *